US008210374B2

(12) United States Patent
Harpole

(10) Patent No.: US 8,210,374 B2
(45) Date of Patent: Jul. 3, 2012

(54) RACKABLE COLLAPSIBLE STACKABLE UNIT

(76) Inventor: Alfred Knox Harpole, LaGrange, GA (US)

( * ) Notice: Subject to any disclaimer, the term of this patent is extended or adjusted under 35 U.S.C. 154(b) by 1008 days.

(21) Appl. No.: 10/581,365

(22) PCT Filed: Dec. 2, 2004

(86) PCT No.: PCT/US2004/040112

§ 371 (c)(1),
(2), (4) Date: Jun. 16, 2008

(87) PCT Pub. No.: WO2005/056392

PCT Pub. Date: Jun. 23, 2005

(65) Prior Publication Data

US 2008/0237168 A1 Oct. 2, 2008

Related U.S. Application Data

(60) Provisional application No. 60/526,148, filed on Dec. 2, 2003, provisional application No. 60/530,255, filed on Dec. 18, 2003.

(51) Int. Cl.
*A47B 47/00* (2006.01)

(52) U.S. Cl. ..... 211/195; 211/194

(58) Field of Classification Search ..... 211/195, 211/188, 186, 149, 194, 183, 175, 182, 60.1; 108/53.1, 115, 92; 312/258; 248/166
See application file for complete search history.

(56) References Cited

U.S. PATENT DOCUMENTS

| | | | | | |
|---|---|---|---|---|---|
| 2,699,911 | A | * | 1/1955 | Chase et al. | 108/53.5 |
| 2,954,197 | A | | 9/1960 | Laird | |
| 2,956,763 | A | * | 10/1960 | D'Arca | 108/53.1 |
| 3,499,398 | A | | 3/1970 | Murray | |
| 3,565,018 | A | * | 2/1971 | Jay | 108/53.1 |
| 3,665,869 | A | * | 5/1972 | Howe | 108/53.1 |
| 3,804,033 | A | * | 4/1974 | Izawa et al. | 108/53.5 |
| 3,857,494 | A | | 12/1974 | Giardini | |
| 3,946,876 | A | * | 3/1976 | Jay | 211/60.1 |
| 4,098,409 | A | * | 7/1978 | Massey | 211/195 |
| 4,177,907 | A | * | 12/1979 | Funaioli et al. | 220/1.5 |
| 4,258,631 | A | * | 3/1981 | Brown | 108/91 |
| 4,659,131 | A | * | 4/1987 | Flournoy, Jr. | 296/3 |
| 5,228,821 | A | | 7/1993 | Gleffe et al. | |
| 5,242,255 | A | * | 9/1993 | Gleffe et al. | 414/403 |
| 5,439,152 | A | | 8/1995 | Campbell | |
| 5,692,625 | A | * | 12/1997 | Filipescu et al. | 211/195 |
| 5,941,398 | A | * | 8/1999 | Harris | 211/60.1 |
| 6,279,763 | B1 | | 8/2001 | Bush | |
| 6,820,752 | B2 | * | 11/2004 | Jeskey et al. | 211/41.14 |
| 7,044,065 | B2 | * | 5/2006 | Arai et al. | 108/53.1 |
| 7,083,369 | B2 | * | 8/2006 | Nyeboer | 410/43 |
| 7,328,804 | B2 | * | 2/2008 | Andre et al. | 206/600 |
| 7,802,526 | B2 | * | 9/2010 | Brady et al. | 108/53.5 |

* cited by examiner

*Primary Examiner* — Jennifer E. Novosad
(74) *Attorney, Agent, or Firm* — Browdy and Neimark, PLLC

(57) ABSTRACT

A rackable, collapsible, and stackable unit including corner posts being foldable inwardly and downwardly, side bars connecting a pair of opposite corner posts, upper end bars connecting a pair of adjacent corner posts, lower end bars connecting the pair of adjacent upright corner posts, a core holder located on the upper end bars for retaining one end of a core, a plurality of hinges, one connected at each joint between each corner post and the side bars, and hinged support braces pivotally and diagonally connected between one of the corner posts and one of the side bars to hold the corner posts in an upright position when the unit is opened and which, in combination with the hinges, makes it possible to fold the corner posts inwardly and downwardly so as to lie substantially flat against the side bars.

10 Claims, 21 Drawing Sheets

RACKABLE COLLAPSIBLE STACKABLE UNIT

CROSS REFERENCE TO RELATED APPLICATIONS

This application claims priority from provisional application Ser. Nos. 60/526,148 and 60/530,255, filed Dec. 2, 2003, and Dec. 18, 2003, respectively, the entire contents of which are hereby incorporated by reference.

FIELD OF THE INVENTION

The present invention relates to collapsible units that can be stacked on top of each other, racked on shelves for storage, and which are quickly assembled from their component parts.

BACKGROUND OF THE INVENTION

Products shipped from their manufacturer are typically loaded onto wooden units. The units are lifted with a forklift on or in a shipping container, for transportation to the ultimate destination, generally a retail outlet. When the goods arrive at their destination, the goods are removed from the shipping container, loaded onto units, and moved to a storage or use location using a forklift or similar device.

On example of such a unit is found in U.S. Pat. No. 6,279,763 to Bush (incorporated herein in its entirety by reference), which discloses a collapsible pallet rack for shipping and storing heavy roll goods having a central mandrel. The rack includes two pairs of adjacent and opposite upright corner posts that fold inwardly and downwardly. Two side bars connect together the pair of upright corner posts. Two pairs of upper and lower end bars are provided. Each pair of upper and lower end bars connect together a pair of adjacent corner posts. On top of each upper end bar is a cradle positioned centrally for receiving one end of the central mandrel. A hold-down plate is fastened on top of each cradle. Two pairs of hinge plates connect the two pairs of corner posts with the two side bars. When the corner posts are folded inwardly and downwardly, the hinge plates cause the corner posts to lie parallel to the side bars, but not flat against them. In particular, when the corner posts are folded, the hinge plates come to rest at an angle with respect to the side bars, and the corner posts extend from the hinge plates. This construction provides a disadvantage in that since the corner posts do not lie flat against the side bars, the units cannot be stacked on top of one another when they are in the folded position. If they were stacked, the weight of the upper unit would bear on the hinge plate, possibly causing it to bend or break.

Other examples can be found in U.S. Pat. Nos. 5,692,625, 3,857,494, and 2,954,197 (each of which is incorporated herein in its entirety by reference). However, there is a need for a rackable, collapsible and stackable pallet that can be collapsed into a small size with ease, and which can be easily opened and stacked.

SUMMARY OF THE INVENTION

It is an object of the present invention to provide a rackable, collapsible and stackable unit for transporting goods, which does not suffer from the disadvantages seen with the prior art constructions.

It is a further object of the present invention to provide a rackable, collapsible and stackable unit for transporting goods, which can be stacked in an open and in a closed position.

It is another object of the present invention to provide rackable, collapsible and stackable units for transport of goods.

It is another object of the present invention to provide rackable, collapsible and stackable units for transport of goods that can be stacked in the open position and in the collapsed position.

According to one embodiment of the present invention, a rackable, collapsible, and stackable unit including two pairs of adjacent and opposite upright corner posts being foldable inwardly and downwardly, two side bars, each side bar connecting the pair of opposite upright corner posts, a pair of upper end bars, each upper end bar connecting the pair of adjacent upright corner posts, a pair of lower end bars, each lower end bar connecting the pair of adjacent upright corner posts, positioned at a point lower than the pair of upper end bars on the corner posts, at least two first core holders located on the pair of upper end bars for retaining a core, a plurality of hinges, one connected at each joint between each corner post and the side bars, and at least four hinged support braces, each one pivotally and diagonally connected between one of the corner posts and one of the side bars to hold the corner posts in an upright position when the unit is opened and which, in combination with the hinges, makes it possible to fold the corner posts inwardly and downwardly so as to lie substantially flat against the side bars.

BRIEF DESCRIPTION OF THE DRAWINGS

A rackable, collapsible and stackable unit according to one embodiment of the present invention is shown in FIG. 1A.

DETAILED DESCRIPTION OF THE INVENTION

Figure 1A:
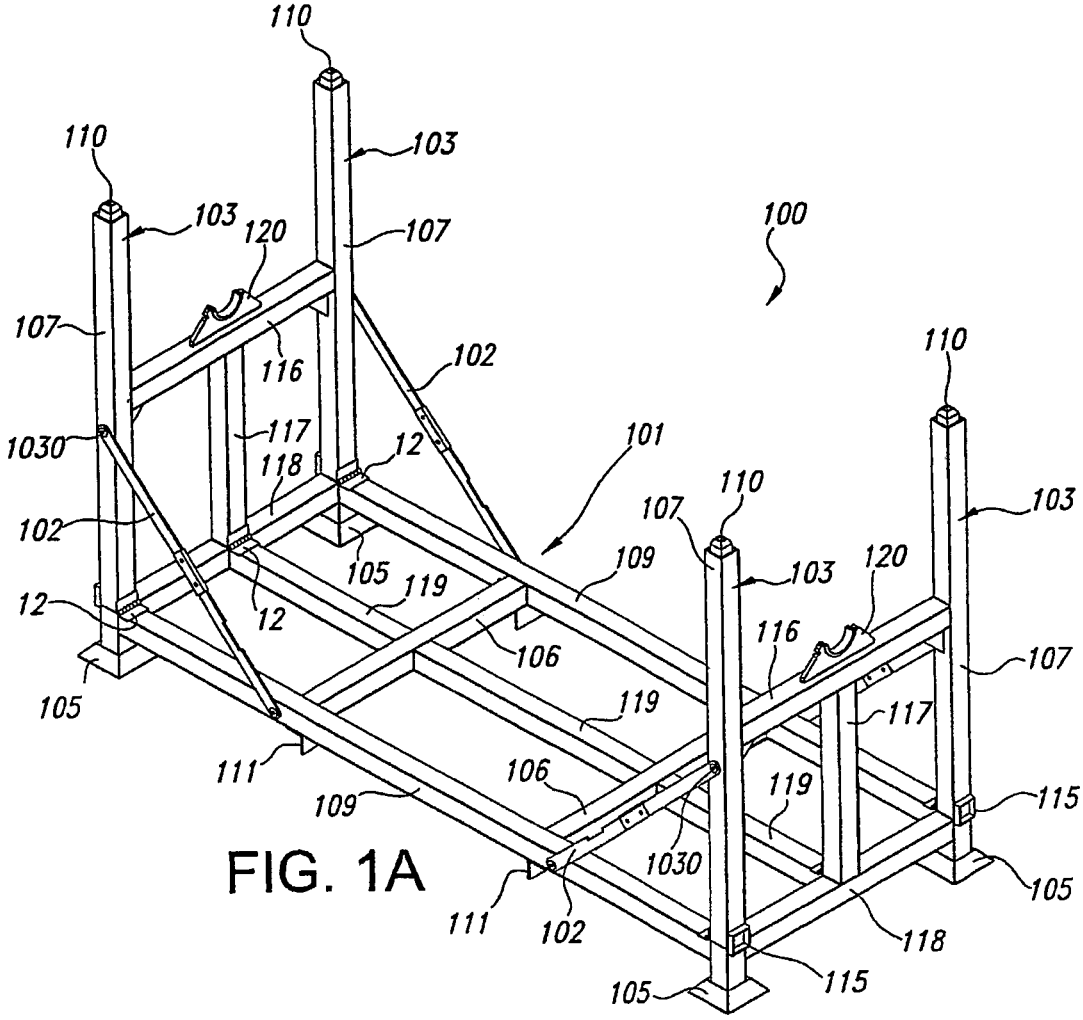
FIG. 1B illustrates one embodiment of a hinge that can be used in the embodiments of the present invention.
FIG. 1C illustrates one embodiment of a hinged support brace that can be used in the embodiments of the present invention.
FIG. 1D illustrates a core that can be stored in the unit according to the present invention.

In FIG. 1A, the unit 100 is shown according to one embodiment of the present invention. The units of the present invention can be used as pallets, racks, skids, and the like, and are returnable and recyclable. The units will last for years under normal circumstances, and offer the versatility of being used as storage and/or shipping units as needed. They can carry multiple loads and support suspension packaging. The unit is capable of holding more than 20,000 pounds. The units can be stacked one on top of another in both a closed and an open position. Additionally, the units can be racked on storage shelves when fully loaded.

In the embodiment of FIG. 1A, the unit 100 includes two pairs of adjacent and opposite upright corner posts 103. Two side bars 109 connect together the pairs of opposing corner posts 103. There are two pairs of upper (first) end bars 116 and lower (second) end bars 118. Each pair of upper and lower end bars 116 and 118, respectively, connect together one pair of adjacent corner posts 103. A pair of upright end support bars 117 may be connected between the upper end bars 116 and lower end bars 118.

In the exemplary embodiment shown in FIG. 1A, a pair of cross bars 106 connect the side bars 109 together and longitudinal bars 119 are connected between the lower end bars 118 and the cross bars 106, and between the two cross bars 106. However, this embodiment is shown as an example configuration only. Other configurations are possible, as would be understood by those of ordinary skill in the art, such as two longitudinal bars connected between the lower end bars 118 and one or two cross bars connected between the side bars and the longitudinal bars, see e.g., FIGS. 3, 10, and 27.

Figure 7:
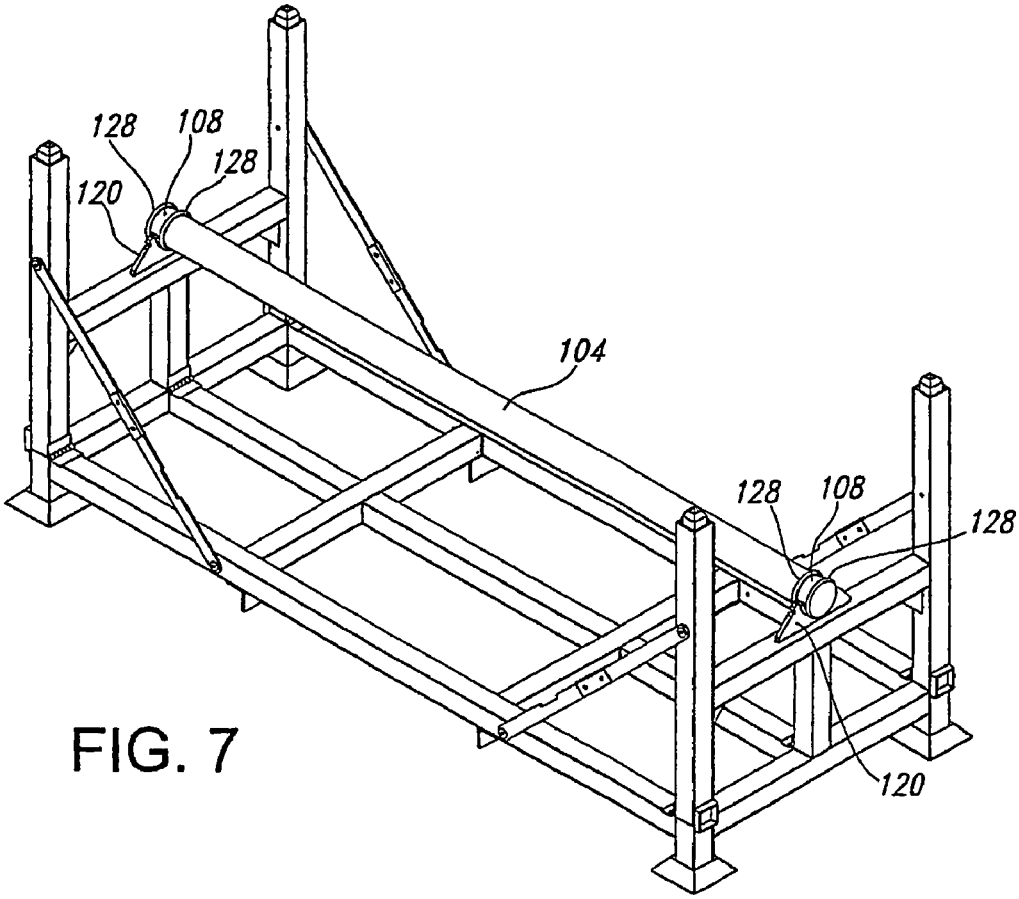
FIG. 7 shows the unit with the core in place on the unit according to one embodiment of the present invention.
Figure 8:
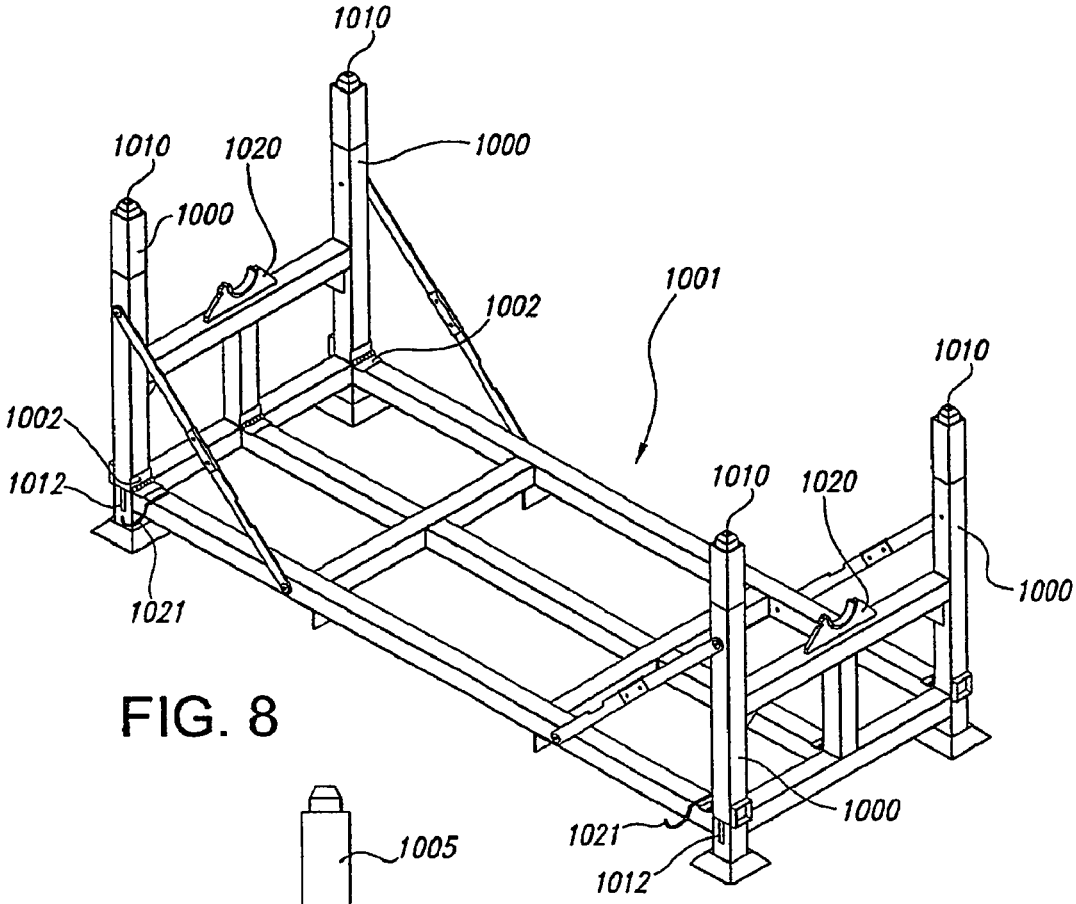
FIG. 8 shows another unit having according to another embodiment of the present invention.

As shown in FIGS. 1A-1D, the rackable, collapsible and stackable unit 100 according to one embodiment of the present invention is made to hold a core 104 during shipment and storage. As shown, e.g., in FIG. 7, the core 104 can be positioned on core holders 120 connected on each end of the unit. In particular, on top of each top end bar 116, there is one core holder or cradle 120 positioned thereon in a substantially central position for receiving one end of the core 104.

Hinges 12 are provided at both ends of the unit 100 so that the unit can be quickly collapsed. In particular, in the embodiment shown in FIGS. 1A-1D, hinges 12 are connected between corner posts 103 and side bars 109 and between longitudinal bars 119 and upright end support bars 117. In the event the configuration is such that there is no longitudinal bar at the location of the center post, the hinge is connected between the center post and the lower end bar.

Figure 1B:
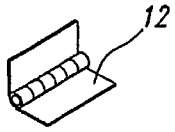

FIG. 1B illustrates the hinge 12 that can be pinned or bolted to the corner posts 103 side and longitudinal bars 109, 119, respectively. This can be a solid piece of metal and/or detachable from the unit, making it possible to use the unit in many different ways. Units without this hinge can have clevis pins, bolts, or push rods located in the area of fold to lock the corner posts in place as long as that fold is capable of folding the corner posts 103 and upright end support bars 117 substantially flat against the base of the unit. Other possible connectors can be used, within the skill of the ordinary artisan.

Figure 9A:
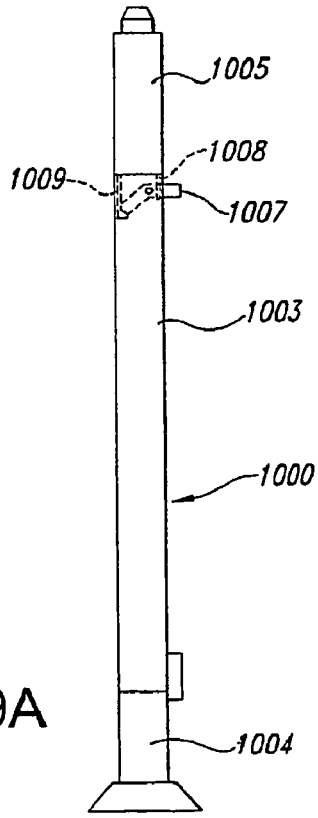
FIG. 9A shows a corner post according to the embodiment shown in FIG. 8.
Figure 9B:
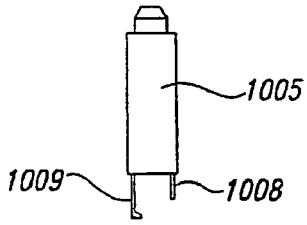
FIGS. 9B and 9C show the top and bottom portions, respectively, of the corner post of FIG. 8.

In the embodiments shown herein, each corner post, and where applicable, a center post, is comprised of multiple parts, including at least a foot (or foot portion 105) and an upper leg (or upper leg portion 107). The foot portion 105 includes a leg section that fits in a trapezoidal plate. In some embodiments, a middle leg (or middle leg portion) may be included between the upper leg and the foot. The connection between upper leg portions 107 and foot portions 105, and between the upper leg portions, the middle leg portions and the foot portions, can be any type of connection that secures the upper leg portions 107 to foot portions 105, such as that shown in FIGS. 4B and 9A. Alternative joints, such as mating blocks and corresponding mating holes, are considered to be within the skill of the ordinary artisan.

Figure 1C:
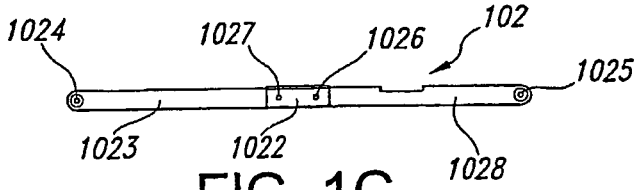

As shown in FIG. 1C, hinged support braces 102 connect each corner post 103 to a side bar 109 at pivot pins 1025, 1024, respectively. Hinged support braces 102 consist of two end plates 1028, 1023, each of which having a hole on both sides to accommodate pivot pins 1024, 1025, 1026, and 1027. Pivot pins 1026 and 1027 connect the center plate 1022 to a respective end plate 1028, 1023.

Each corner post 103 has a top end block 110. The top end block is of scalable dimensions and can be round, square, rectangular, cone shaped, octagonal, or any other suitable shape. The top end blocks 110 are sized to fit an opening (not shown) in the underside of foot portions 105 at the bottom of corner posts 103. When the units 100 are stacked one on top of another in the open position, the top end blocks 110 engage in these openings to secure the two units together.

A retaining member or stacking lock 115 is positioned on an outer end side of each corner post 103. When the unit 100 is in the collapsed position, as shown in part in FIG. 17, the retaining member 115 on each corner post 103 mates with the underside of foot portion 105 of the top unit (not shown). This serves to keep the stacked units secure in their relative position and safe from accidental slippage off one another.

One option that is shown in FIG. 1A, and others, is the provision of brackets 111 on the underside of the base 101 of the unit 100. When the unit 100 is to be lifted by fork lift (not shown), the prongs of the lift engage the brackets 111 to position the unit on the lift to allow the operator to move the unit safely. Other configurations of such brackets are considered within the skill of the ordinary artisan.

Figure 2A:
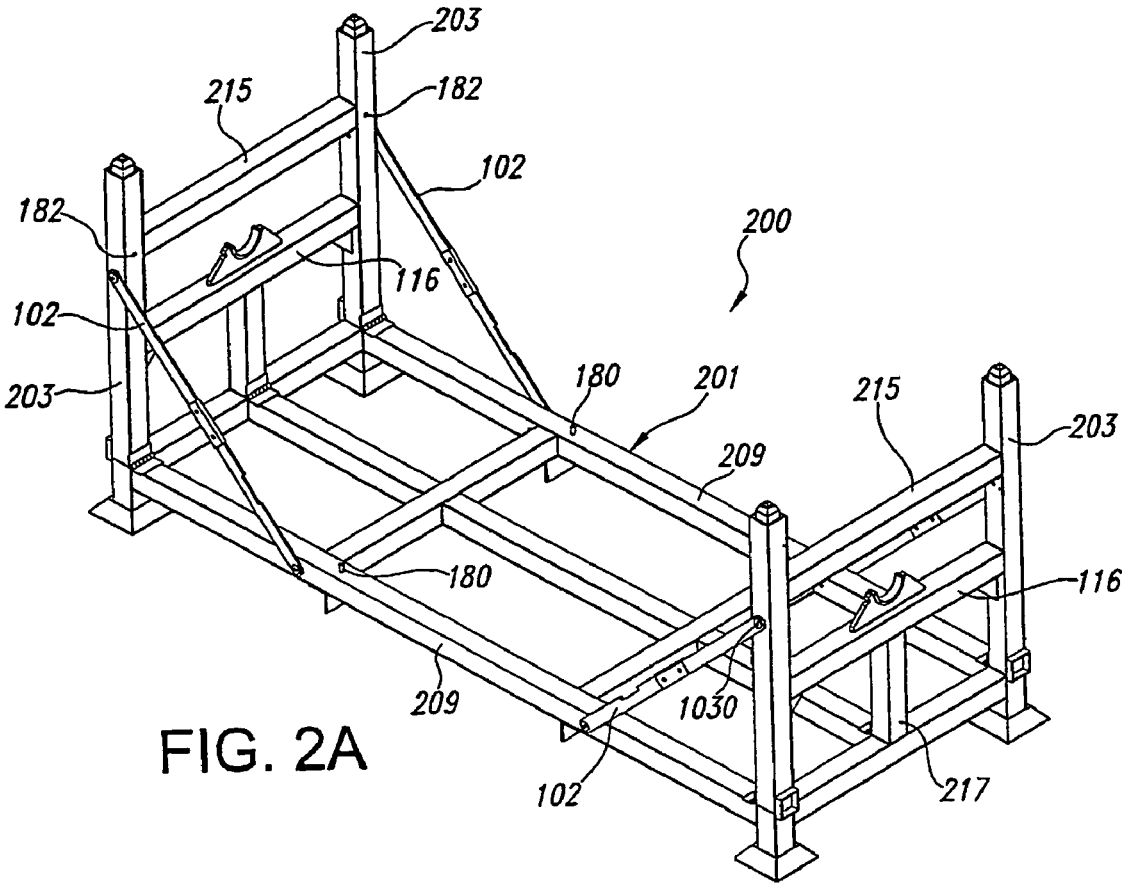
FIG. 2A shows a unit according to another embodiment of the present invention.
Figure 2B:
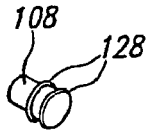
FIG. 2B shows an end cap that can be used with the core according to the present invention.

In the embodiment shown in FIG. 1A, the attachment point 1030 of the pivot pin 1024 of the hinged support braces 102 to the corner posts 103 is about at the level of the upper end bars 116. In the exemplary embodiment shown in FIG. 2A, the smaller unit 200 has hinged support braces 102 that connect the base 201 to the corner posts 203. Each corner post 203 can be provided with a top end block 110 (FIG. 2D) of the kind shown in FIG. 1A, that makes it possible to join two or more corner posts 203 in a rigid fashion. In this embodiment, the end upright support bars 217 are shorter than the upright end support bars 117 shown in FIG. 1A. Thus, the end bars 116 are connected between the corner posts 203 at a lower position, and the attachment points 1030 of the support braces 102 to the corner posts 203 are above the position of the end bars 116. Additionally, in the embodiment shown in FIG. 2A, and optional upper end support bar 215 is provided connecting the adjacent corner posts. These optional upper end support bars 215 will provide additionally stability for the unit. In other respects, this embodiment is the same as that described in FIG. 1A, and no further description will be provided for the sake of brevity.

Figure 1D:
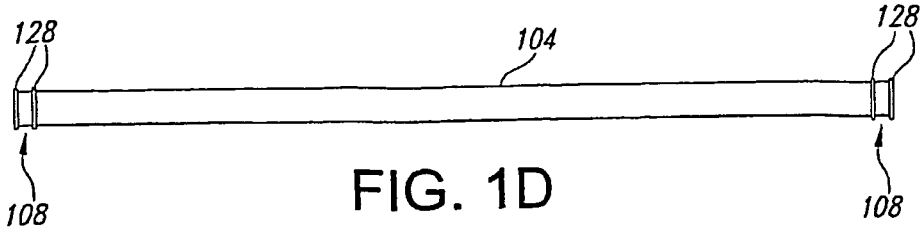
Figure 2C:
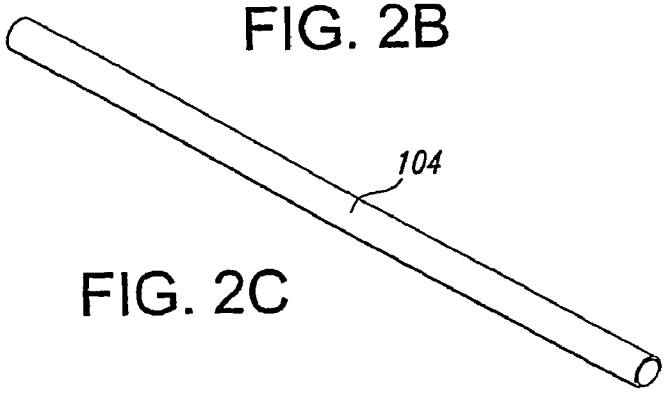
FIG. 2C shows the core without the end caps according to the present invention.
Figure 2D:
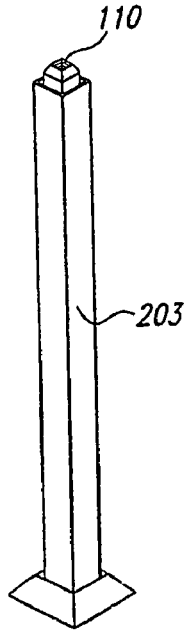
FIG. 2D shows a corner post according to one embodiment of the present invention.

The core 104 shown in FIGS. 1D and 2C according to one embodiment of the present invention is a mandrel on which can be stored rolled goods, such as carpet, fabric, paper, plastic film, bagging material, and the like. This mandrel is rigid and relatively strong so that it can support the goods that are stored thereon. While the core is generally made of graphite or aluminum, any suitable material can be used to make the core. The core can be solid or it can be hollow. In the latter case where the core is used to support a roll of material, the material forming the core ought to be strong and sturdy enough to resist collapse when loaded with the rolled goods to be transported and/or stored thereon.

According to one embodiment of the present invention, the goods are rolled on the core 104 and are held thereon by the core plugs 108. In particular, the core 104 may be provided with one or more core plugs 108 at either end of the core. The core plugs 108 include ridges 128 (FIGS. 1D, 2B, and 7) between which the core holder 120 fits when the core 104 is stored thereon. The ridges 128 prevent the core 104 from rolling around and shifting when in place on the core holder 120. Although not specifically shown, it is possible to form the ridges on the core itself, near the end portion, within the scope of the present invention. In this case, the core plug can be flat, or if the core is being used to store a roll of material, may be omitted altogether.

According to another embodiment of the present invention, the core 104 may be sealed by the core plugs 128 to store goods to be shipped in the hollow core. This makes the core stronger, but also makes it possible for the core to become packaging for goods to be shipped. For example, any flowable material (not shown), such as peat moss, gravel, fertilizer, and the like, or rolls of plastic bags, for example, can be introduced into the core for shipment. The core plugs 108 on both ends of the core retain the material inside until the material needs to be removed from the core. At the final destination, the core can then be used as a package for the goods, which are removed as needed.

Figure 3:
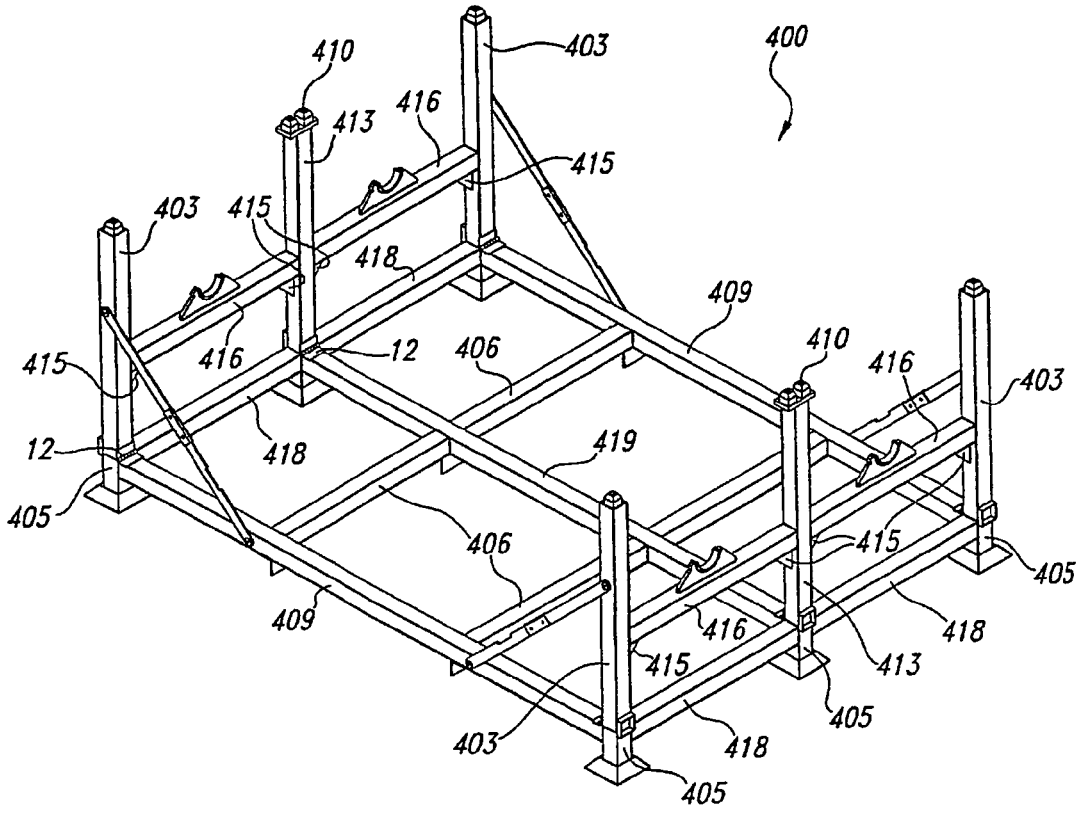
FIG. 3 show a double-wide unit according to one embodiment of the present invention.

FIG. 3 shows a double-wide unit 400 that includes two opposite side bars 409 connected to two pairs of corner posts 403 with hinges 12. Between the two pairs of corner posts 403 are two opposing center posts 413, each connected to the corner posts 403 by a pair of upper (first) and lower (second) end bars 416, 418. In the embodiment shown in FIG. 3, the center posts 413 are connected to each other by a center longitudinal bar 419 with hinges 12. The hinges 12 allow the corner and center posts 403, 413 to fold flat when the double-wide unit 400 is collapsed into its collapsed position. Two pairs of support bars 406 are connected between the center longitudinal bar 419 and each side bar 409. On top of each of the center posts 413 are located two top end blocks 410, which can engage a recess (not shown) in the underside of the foot portions 405, when the units 400 are stacked in their open position. The two top end blocks 410 on the center posts 413 provide extra stability when the double-wide unit 400 is stacked one on top of another in the open position.

Additionally, braces 415 may be included under the upper end bars connecting the corner and center posts 403, 413 to the upper end bars 416, to provide additional support to withstand the weight of the core when the unit 400 is loaded. In other respects, this embodiment is the same as that described in FIG. 1A, and no further description will be provided for the sake of brevity.

Figure 4A:
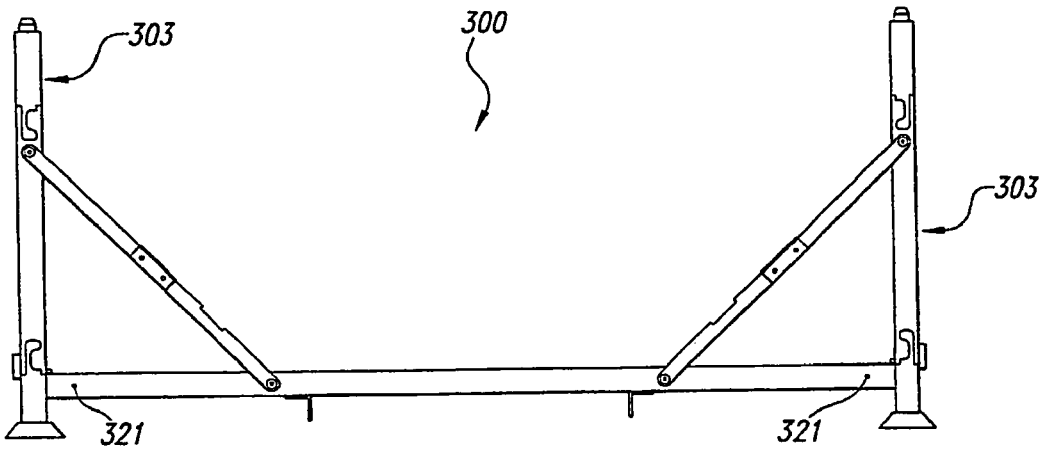
FIG. 4A is a side view of a unit according to another embodiment of the present invention.
Figure 4C:
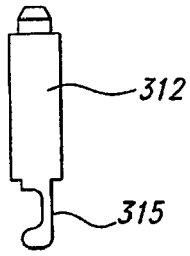
FIGS. 4C and 4D show the top and bottom portions, respectively, of the corner post shown in FIG. 4B.
Figure 4D:
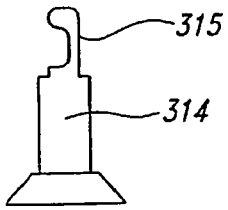
Figure 4B:
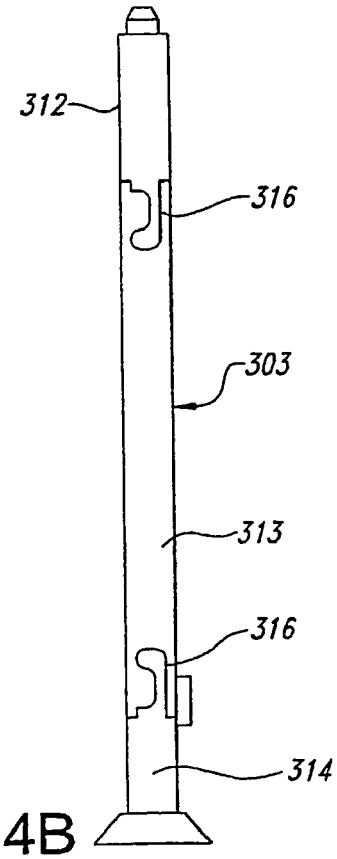
FIG. 4B shows a corner post used in the embodiment of FIG. 4A according to another embodiment of the present invention.

FIG. 4B shows self-locking corner post 303 made up of at least one removable middle leg portion 313 with a removable foot portion 314 and removable upper leg portion 312 according to one embodiment of the present invention. Although only one middle leg portion is shown in this embodiment, it is possible to have more than one middle leg portion, thus extending the height of the corner posts. Further, the middle leg portion(s) can be varied in length, to create longer, or shorter, corner posts.

FIG. 4A shows a side view of the self-locking corner posts 303 used in a unit 300 according to one embodiment of the present invention. FIGS. 4C and 4D show the removable upper leg portion 312 and removable foot portion 314, which can be used to save space in a truck and/or warehouse when the unit is dismantled. This makes the unit completely collapsible with self-contained parts. The feet, middle leg and upper leg portions can be made of round, square, rectangular, cone shaped, octagonal, or other shaped material, or any combination of shapes. The height and width of the foot, middle leg and upper leg portions can be varied in all scalable dimensions in accordance with specific requirements for the product, and they can be stationary or adjustable.

The feet, middle leg and upper leg portions are self-locking by virtue of the mating hooks 315 formed on the lower end of the upper leg portion and on the upper end of the foot portion. The mating hooks 315 are sized so as to fit easily and mate with mating holes 316 formed on both ends of the middle leg portion. In an alternative embodiment the length of the upper leg can be extended and the lower end of the upper leg can be formed with a mating hook 315 that mates with a mating hole formed in the foot (not shown), eliminating the middle leg. Latches, hooks, and catches to be optionally used on the foot portions will vary in accordance with specific requirements for products being stored on or shipped in the units. In other respects, this embodiment is the same as that described in FIG. 1A, and no further description will be provided for the sake of brevity.

Figure 5:
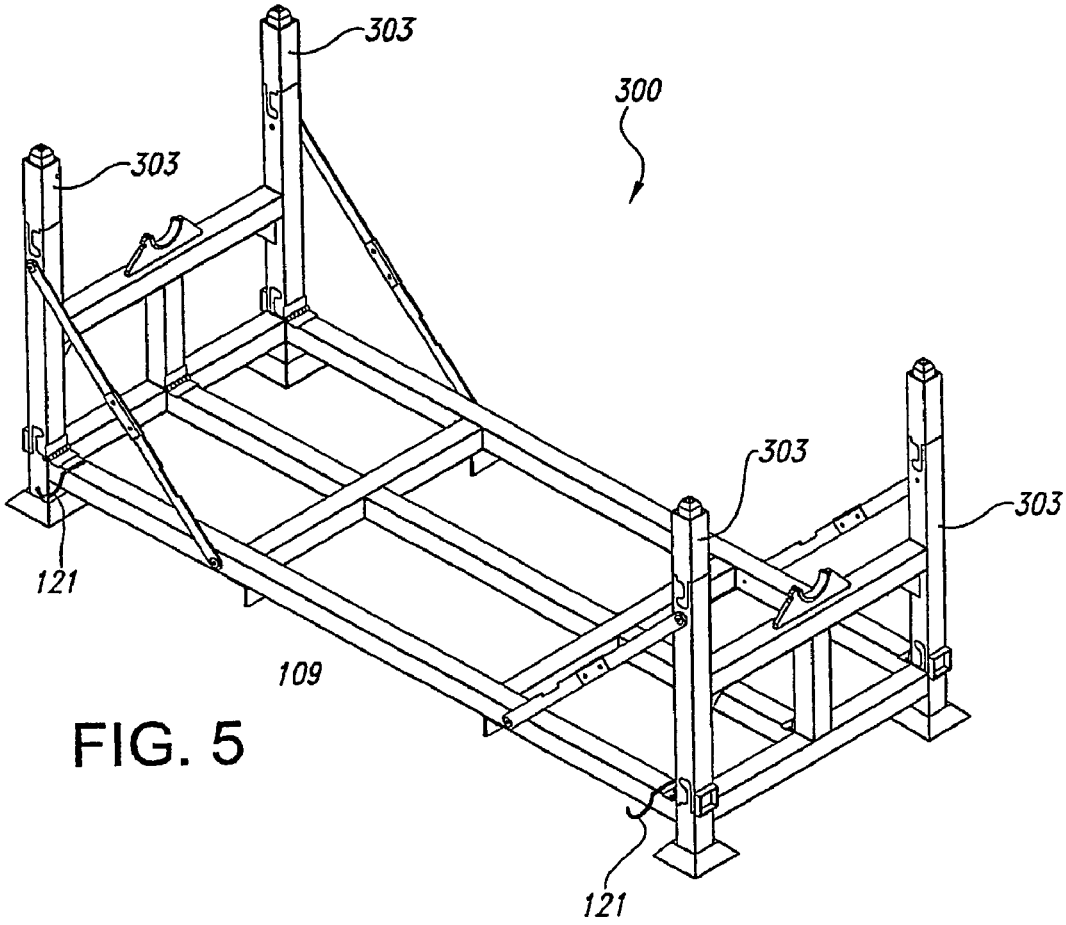
FIG. 5 shows an assembled unit according to another embodiment of the present invention.

FIG. 5 shows an embodiment of a unit 300 that includes a core holder 121 attached to the side bar 109, and is either saddle shaped or has a pin to attach it to the empty core unit while being shipped. All dimensions of the core holder 121 will vary in scalable dimensions to meet specific requirements for the product, and they can be stationary or adjustable. FIG. 5 shows the core holder 121 as it is positioned according to one embodiment of the present invention on the bottom side of the stackable unit 300. The holder 121 can be screwed into the side of the side bar 109 (at holes 321 of FIG. 4A) or corner posts 303, or attached in any known manner in such a way as to provide sufficient support for the empty core 104. The core holder 120 can be used to hold cores when the unit is opened and in storage; the core holder 121 can be used to hold the core during shipment of the unit. In other respects, this embodiment is the same as that described in FIGS. 1A and 4A, and no further description will be provided for the sake of brevity.

Figure 6:
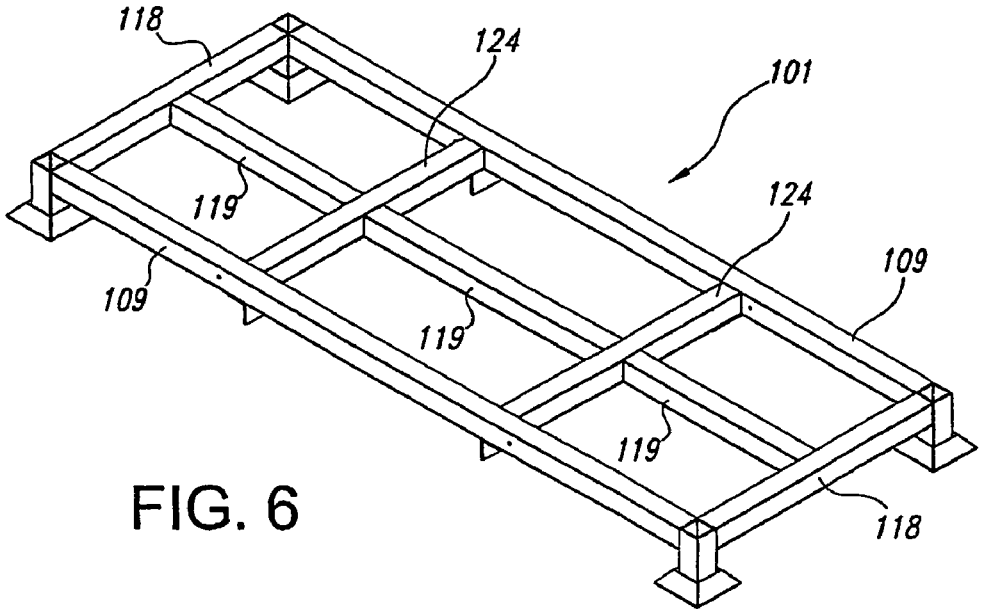
FIG. 6 shows the base of the unit according to one embodiment of the present invention.

FIG. 6 shows the base 101 of the unit according to one embodiment of the present invention, including, in this case, two cross bars 124 and three longitudinal bars 119, one connected between the two cross bars 124 and one between each cross bar 124 and the respective one of the lower end bars 118. The cross bars 124 of the base 101 can be varied in number according to the material placed onto the units within the skill of the ordinary artisan. These bars can be round, square, rectangular, cone shaped, octagonal, or any combination of shapes. All dimensions of the cross bars will vary in scalable dimensions to meet specific requirements for the product, and they can be stationary or adjustable. Further, depending on the anticipated weight requirements, additional cross bars and/or longitudinal bars can be included to provide additional support as required, within the skill of the ordinary artisan. The base 101 is usable with any other embodiment disclosed herein.

The unit 1001 shown in FIGS. 8 and 9A-9C includes self-locking corner posts 1000 including a middle leg portion 1003, a foot portion 1004, and a leg and foot lock lever 1007. Hinges 1002 make it possible to fold the unit 1001 onto itself for storage or shipping. The core (not shown) is held in the core holders 1021 when the unit is in a folded position, and in core holders 1020 when the unit is in its upright, open position.

Additionally, alignment plates 1012 are provided on an outer side of the corner posts 1000, near the bottom of the posts. The alignment plates 1012 are positioned and sized so as to engage the ridges 128 of the core plugs 108 (see, e.g., FIG. 1D) when the unit is in the closed position and a core is stored in the core holders 1021.

The leg and foot locking lever 1007 (shown only connecting the top portion 1005 and the leg portion 1003) includes the lever 1007 pivotally connected to the middle leg portion 1003. When the top portion 1005 is placed in the middle leg portion 1003, the latch 1009 and pin 1008 engage the lever 1007 to hold the lever 1007 in place. This locks the top portion 1005 and the middle leg portion 1003 together. It is within the skill of the ordinary artisan to use the leg and foot lock lever mechanism to connect the middle leg portion 1003 to the foot 1004.

Figure 9C:
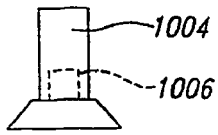

FIG. 9C illustrates a foot portion 1004 with an opening 1006 shown in dashed lines. The opening 1006 is provided in the underside of the foot portion 1004 (and/or in the foot portions of any of the other disclosed embodiments) to engage with the top end blocks 1010 of another unit when the second unit is stacked on top of the first unit in an opened position (see, e.g., FIG. 24). The mating of the top end blocks and the openings in the underside of the foot portions of the corner (and/or center) posts increases the stability of the stacked units.

Figure 10:
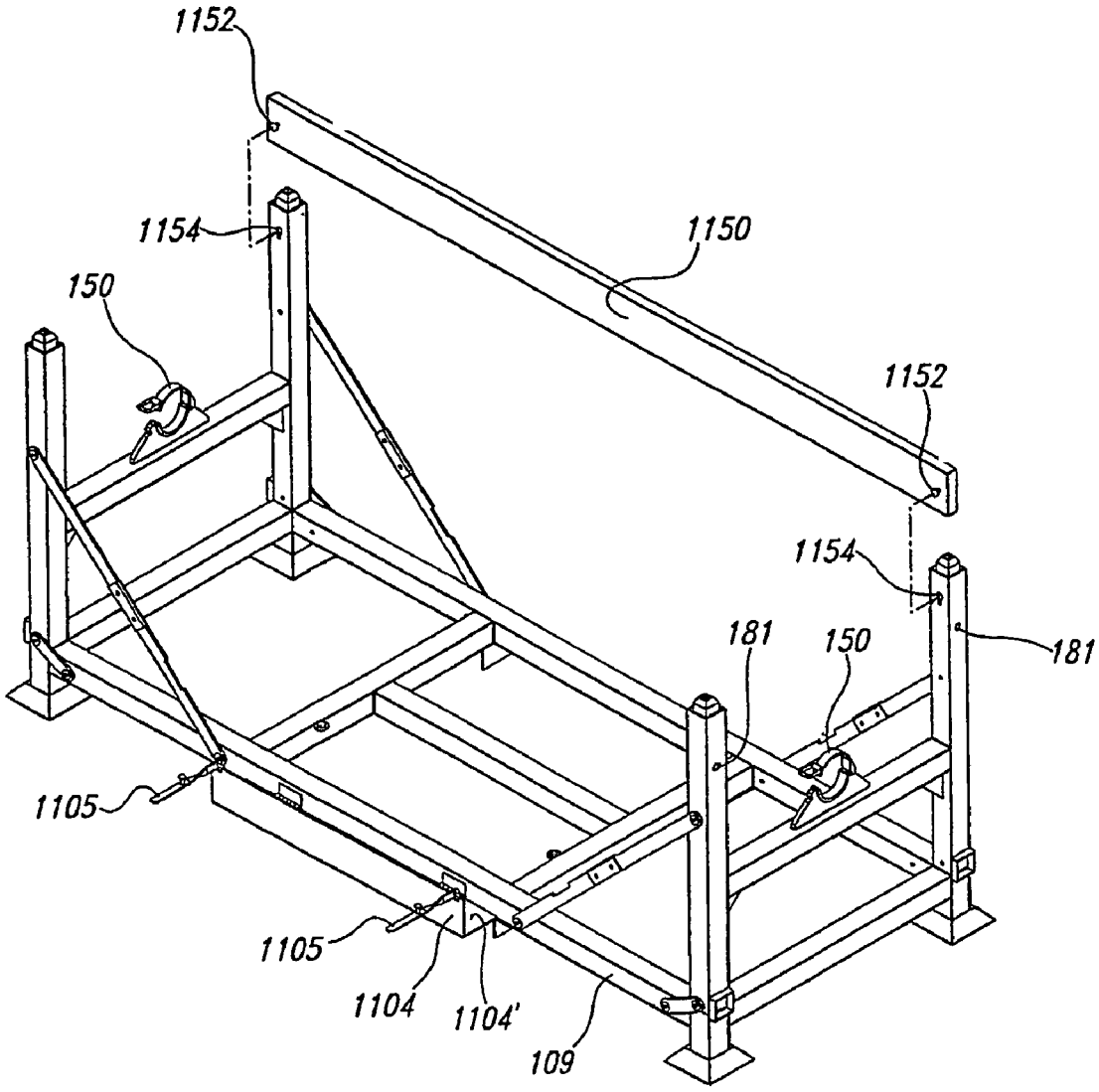
FIG. 10 shows the unit in open position according to another embodiment of the present invention.

FIG. 10 illustrates the use of a stabilizer 1150 to be connected between the opposing corner posts to provide additional stabilization of the unit when it is loaded with a rolled material on a core stored on the core holders in the open position. As shown in the exemplary embodiment shown in FIG. 10, the stabilizer 1150 includes two earnest pins 1152. The corner posts each include a hole or slot 1154, preferably in a key-hole shape, which receives the earnest pins 1152 when the stabilizer 1150 is put on the unit. The holes 1154 can be placed on any surface of the corner posts, or on all for surfaces to allow for the installation of multiple stabilizers. The stabilizers, as with the other disclosed features, can be used with any of the disclosed embodiments, within the skill of the ordinary artisan, as required by the needs of the particular units.

Figure 11:
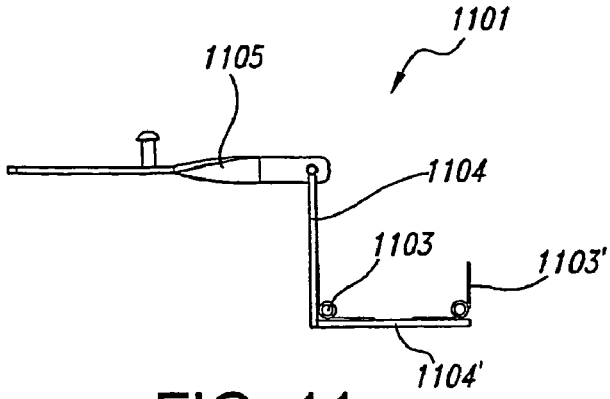
FIG. 11 is a side view of a core protector according to one embodiment of the present invention.
Figure 16:
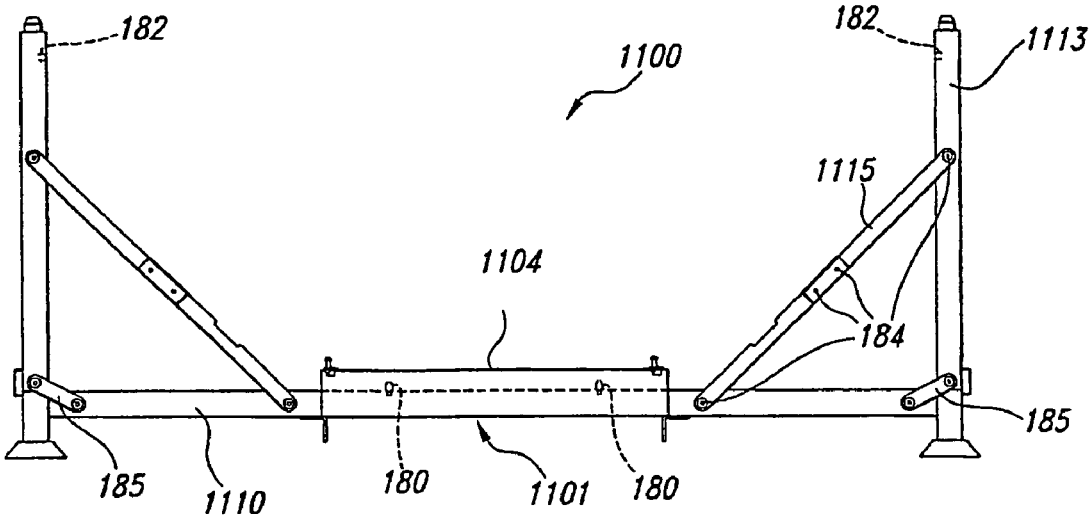
FIG. 16 shows a side view of a unit in the open position with the core protector in place according to one embodiment of the present invention.

FIG. 16 shows a core holder and protector 1101 held in place on a unit 1100 by earnest pins 180 according to one embodiment of the present invention. The core holder and protector 1101 can be used to store and protect the core during shipment of the unit. FIG. 11 shows a side view of the core holder and protector 1101. The core holder and protector 1101 is made of two sheets 1104, 1104' formed of a strong material such as flat iron connected in a manner to form a right angle, or other feasible configuration, through the use of a right angle plate or other feasible configuration, by hinges 1103. Alternatively, the hinges 1103 can be piano hinges that extend along the entire joint between the sheets 1104, 1104'. The hinges 1103 are designed so that the sheet 1104 can be pivoted so as to be on the same plane as sheet 1104' or, at right angles with respect to sheet 1104' either as shown in FIG. 12, or 1800 with respect to the position shown in FIG. 12.

Figure 12:
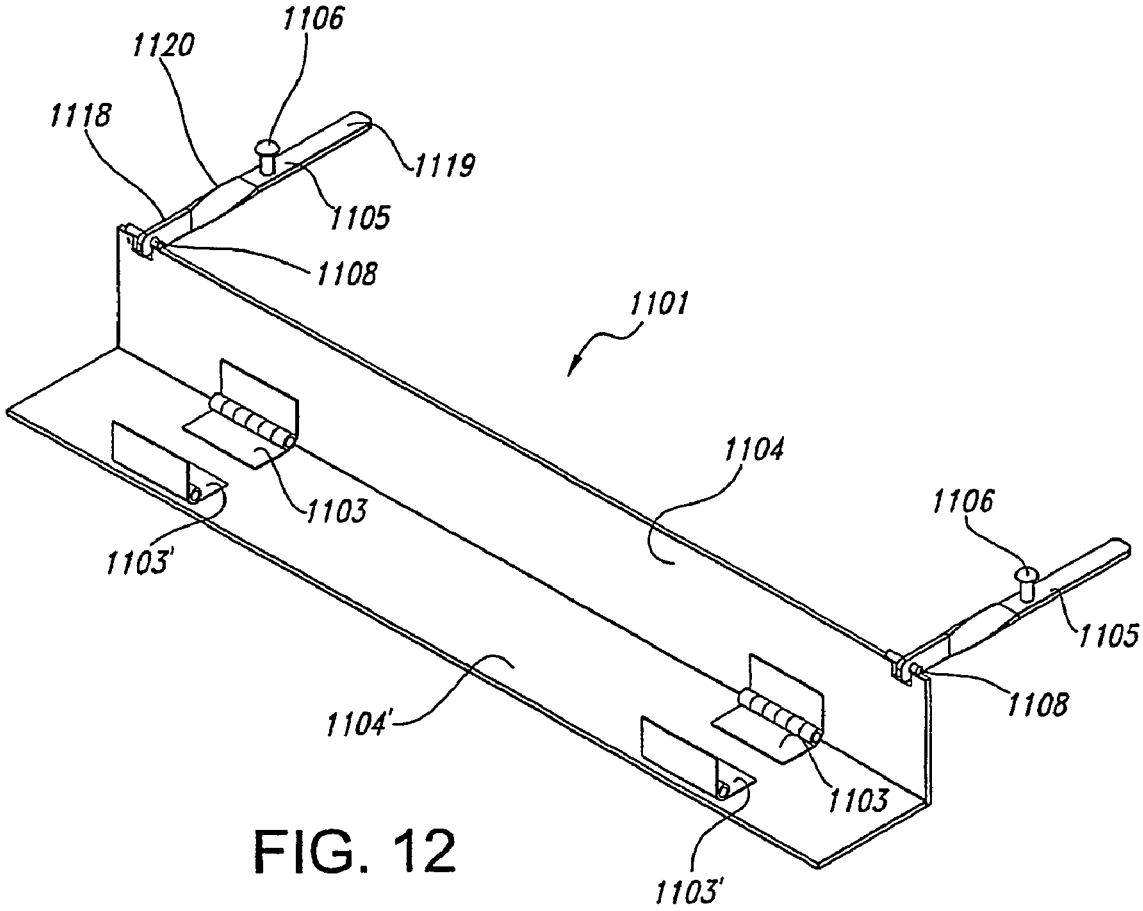
FIG. 12 is a front view of a core protector according to the embodiment of the present invention shown in FIG. 11.

FIG. 12 shows the core holder and protector 1101 for the core while the unit is transported back empty for reuse or stored in a warehouse. The core holder and protector 1101 protects the core from damage from equipment during loading, unloading, and stacking the units. The core holder and protector 1101 is of stackable dimensions and can be made of any suitable material, including but not limited to aluminum, flat metal, composite material, or plastic.

According to one embodiment of the present invention, the sheets 1104, 1104' is of scalable dimensions in width according to the needs and design of the stackable unit to fit the size of the core and/or material being stored. According to one embodiment of the present invention, the sheets 1104, 1104' can be of scalable dimensions in length to be varied according to the needs and design of the stackable unit.

The core holder and protector 1101 protects the core from a forklift during transfer of the unit from one location to another. The core holder and protector 1101 also keeps the core fit flush against the bed of the unit. The earnest pin 180 (FIG. 16) keeps the top of the unit frame secure in place when folded, so that if a forklift bumps the unit from any position, the unit is not bent or damaged.

Figure 14:
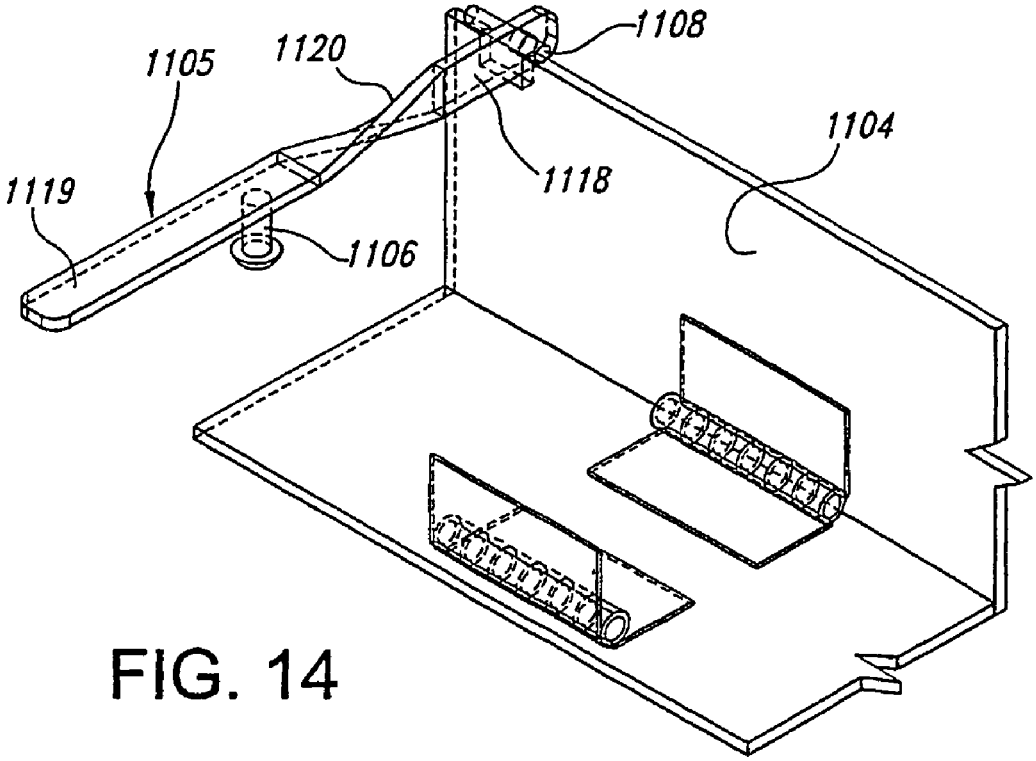
FIG. 14 shows the core protector and latch according to another embodiment of the present invention.

FIGS. 12 and 14 show a front view of the core holder and protector 1101 having arms 1105 that are connected to sheet 1104 via pins 1108. According to one embodiment of the present invention, arms 1105 have a first portion 1118 and a second portion 1119 that pass through planes that are perpendicular to one another. First portion 1118 and second portion 1119 meet at a twist point 1120. The first portion 1118 contains the pins 1108 which connect the arms 1105 to the sheet 1104. The second portion of arms 1105 include latches 1106, which, when the core holder and protector 1101 is in a closed position (see FIG. 10), are inserted into a hole 181 on the side bar of the unit. Alternatively, the latches 1106 can be inserted in an opening (not shown) in one of the longitudinal bars of the base.

Figure 21:
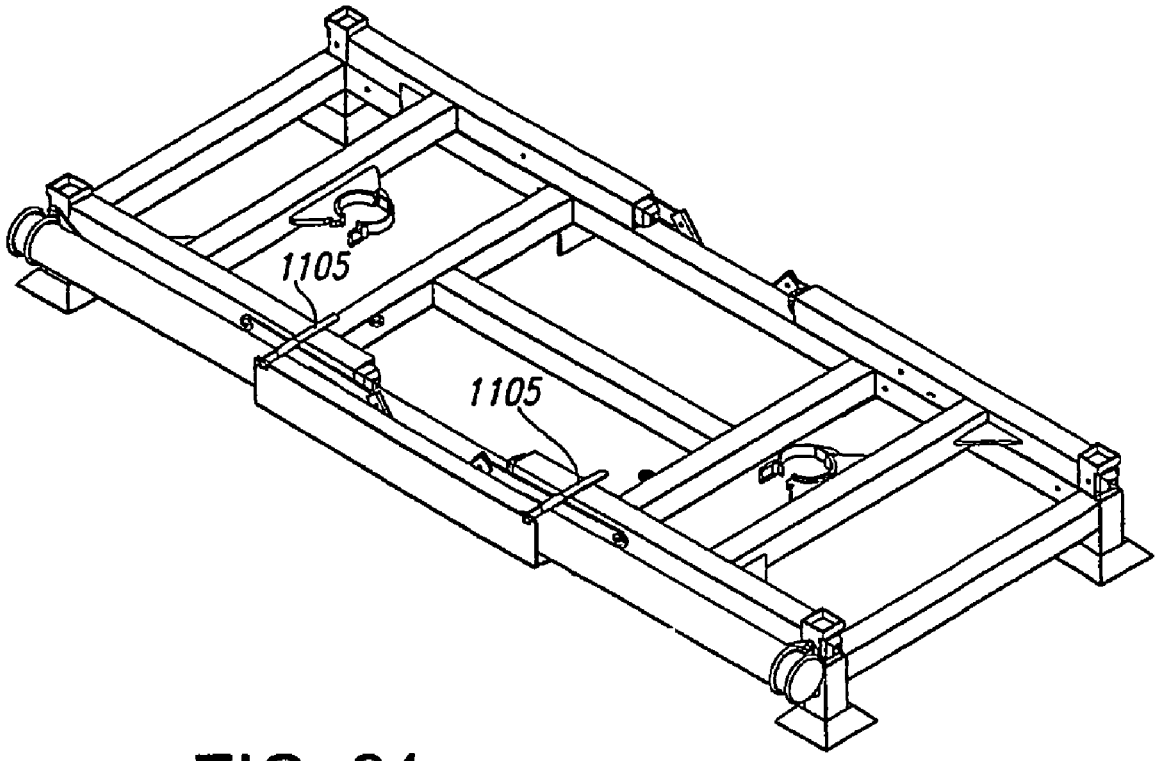
FIG. 21 is a folded view of a unit according to one embodiment of the present invention in which a core is stored in a core protector on the outside of the unit.

Further, arms 1105 can be folded over the corner posts in a folded position, and the latches 1106 (not shown) can be inserted in hole 181 on the corner post, so that when the unit is folded in on itself, the core holder and protector 1101 is latched onto the corner posts so as to keep the unit closed and the core protected, as shown in FIG. 21, according to one embodiment of the present invention.

FIGS. 2A and 16 show earnest pins 180 on side bars 201 and 1110, respectively, and holes 182 on corner posts 203 and 1113, respectively, which are optional for the units of the present invention. The earnest pins 180 are designed to secure the corner posts in place when the unit is in the closed position. The earnest pins 180 are an additional safety feature, so that if a forklift or anything else hits the corner posts of the unit, the unit will remain in a collapsed position and will not cause damage or collapse of the stackable units while the units are stacked one on top of each other. The earnest pins can be round, square, rectangular, cone shaped, octagonal, or any combination of the above. The earnest pins 180 are made of scalable dimensions, and can be made of any suitable material, including but not limited to aluminum, expanded metal, perforated metal, solid metal, or composite material. The holes 182 are positioned and sized so as to easily but firmly receive earnest pins 180 therein when the unit is closed. Additional earnest pins and holes can be provided on the upper leg portions and the corresponding positions on the middle leg portions to secure the upper leg portions to the middle leg portions and prevent relative movement of the leg portions when the unit is closed.

Figure 17:
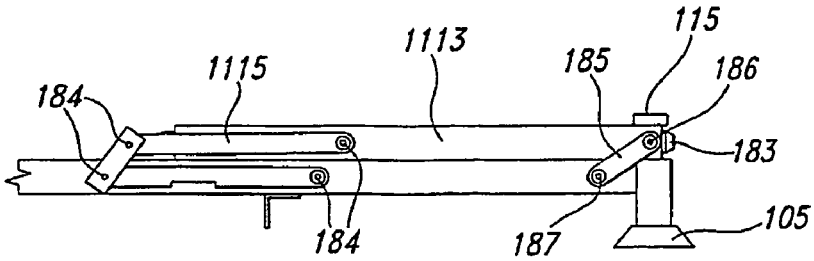
FIG. 17 illustrates a double-pinned hinge for the corner posts of the collapsible unit according to one embodiment of the present invention.

As shown in FIG. 17, the leg portions 1113 may also be equipped with a mating block 183, an additional safety feature which keeps the legs straight and locked in place when the unit is upright, so that if the unit is hit or moved the unit remains stationary as if it were constructed in one piece. The mating block 183 is inserted into a depression (not shown) in the foot 105 when the leg portion 1113 stands upright. The pivot points 184 work in union with the other hinge 185 of the unit, moving forward, backward, up, down, and rotating on the pivot points.

Figure 13:
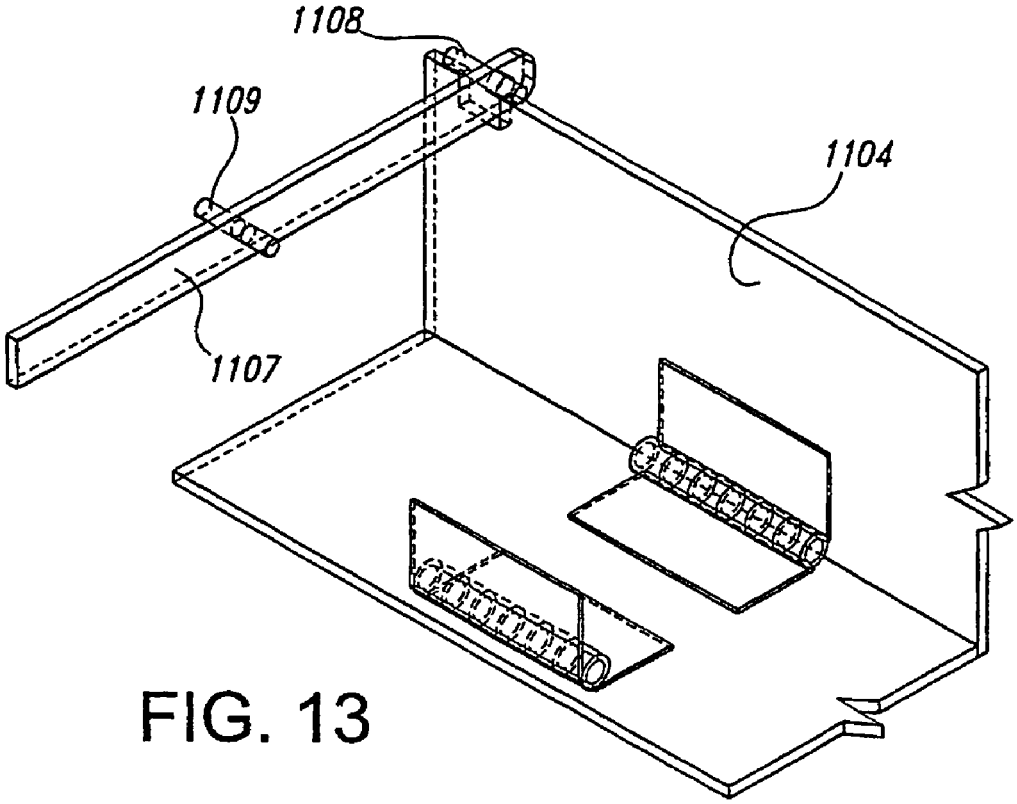
FIG. 13 shows the core protector and latch according to one embodiment of the present invention.

According to another embodiment of the present invention as shown in FIG. 13A, the sheet 1104 can be connected to an arm 1107 via pins 1108. Arm 1107 according to this embodiment, is a straight bar that includes pins 1109 located in approximately the middle of the bar. The pins 1109 can be inserted in an opening (not shown) in the side bar of the unit for securing the core protector 1101 in its closed position around a core (not shown). Alternatively, the pins 1109 can be inserted in an opening (not shown) in one of the longitudinal bars of the base or in the openings in the corner posts when the unit is closed (such as holes 181 shown in FIG. 10). The arm 1107 is made of scalable dimensions, and can be made round, square, rectangular, cone-shaped octagonal or any other suitable shape. The arm 1107 can be made of aluminum, flat metal, composite material, rubber, plastic, straps, cords, bolt cable, string, etc.

FIG. 17 also shows the stacking lock 115 according to one embodiment of the present invention. The stacking lock 115 is designed to keep one unit as close as possible to the next unit without the requirement for strapping down the units. The stacking lock 115 interlocks the units during shipping or storage. Although a square stacking lock is shown, the stacking lock can be of any desired configuration, including round, square, rectangular, cone-shaped, octagonal, etc. The stacking lock can be made of aluminum, expanded metal, perforated metal, solid metal, composite material, plastic or rubber.

Figure 18:
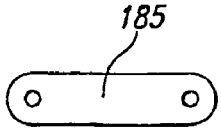
FIG. 18 shows the double-pinned hinge according to the embodiment of the present invention shown in FIG. 17.

FIG. 18 shows a double pinned hinge 185 for connecting the side bars to the corner posts of the collapsible stacking unit of the present invention. Although the hinges 185 are shown only on the outside of the base, it is understood by one of ordinary skill in the art that another set of hinges 185 can be placed on the inside of the base to provide further sturdiness of the unit. The double pinned hinge 185 has two attachment pins, pin 186 and pin 187. Hinge 185 is designed to rotate several degrees on both parts so that the unit, when folded, can move forward and/or backward. The hinge 185 is made of scalable dimensions, and can be made of any suitable metal, including aluminum, expanded metal, perforated metal, solid metal, or a composite material. Additionally, according to one embodiment of the present invention, when the legs 1113 are turned inward to fold the unit 1100 onto itself, the hinge 1115 rotates at all its pivot points 184 to close as shown in FIG. 17. Other configurations for the hinge 1115 are within the skill of the ordinary artisan.

Figure 15A:
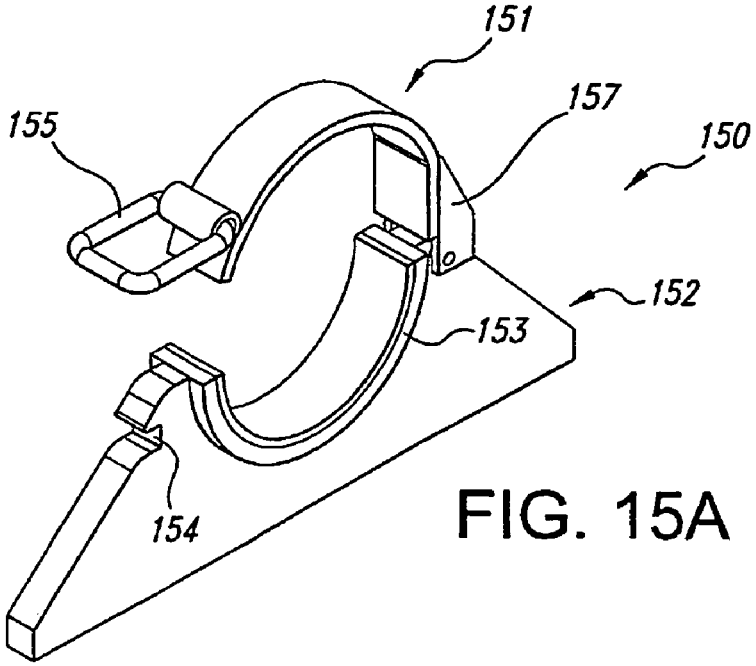
FIG. 15A shows a stacker core lock according to one embodiment of the present invention.
Figure 15B:
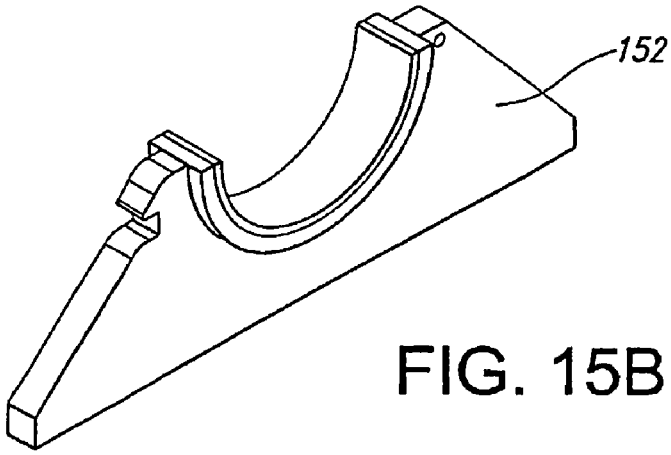
FIG. 15B shows the base of the core lock according to one embodiment of the present invention.
Figure 15C:
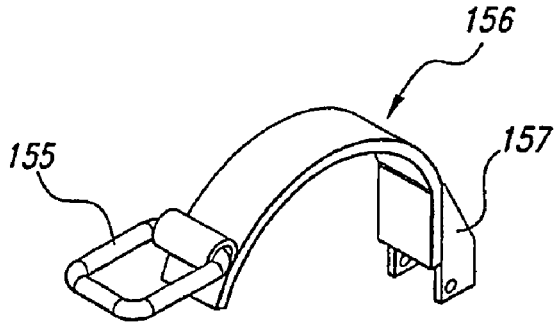
FIG. 15C shows the top of the core lock according to one embodiment of the present invention.

FIGS. 15A, 15B and 15C show a core lock 150 for use in the collapsible units of the present invention. The core lock 150 holds the core of the unit in constant position, not permitting any slippage during use of the core centering frame in the upright position. The core lock 150 is of scalable dimensions. Although a round core lock is shown, the core lock can be of any desired configuration, including round, square, rectangular, cone-shaped, octagonal, etc. The core lock can be made of aluminum, expanded metal, perforated metal, solid metal, composite material, plastic or rubber.

FIG. 15A shows the core lock 150 in a semi-closed position, in which the top 151 of the core lock 150 is shown having a latch buckle 155 on the open end thereof. The base 152 includes a core holder surface 153 and a notch 154. The top 151 of the core lock 150 is pivotally connected to the base 152 via hinge 157. The notch 154 in the base 152 is constructed so as to receive the latch buckle 155 (FIG. 15B) when the core lock is closed, so as to lock the top 151 in position. FIG. 15B shows the base 152 of the core lock 150 with the top 151 removed. FIG. 15C illustrates the top 151 of the core lock 150.

Figure 19:
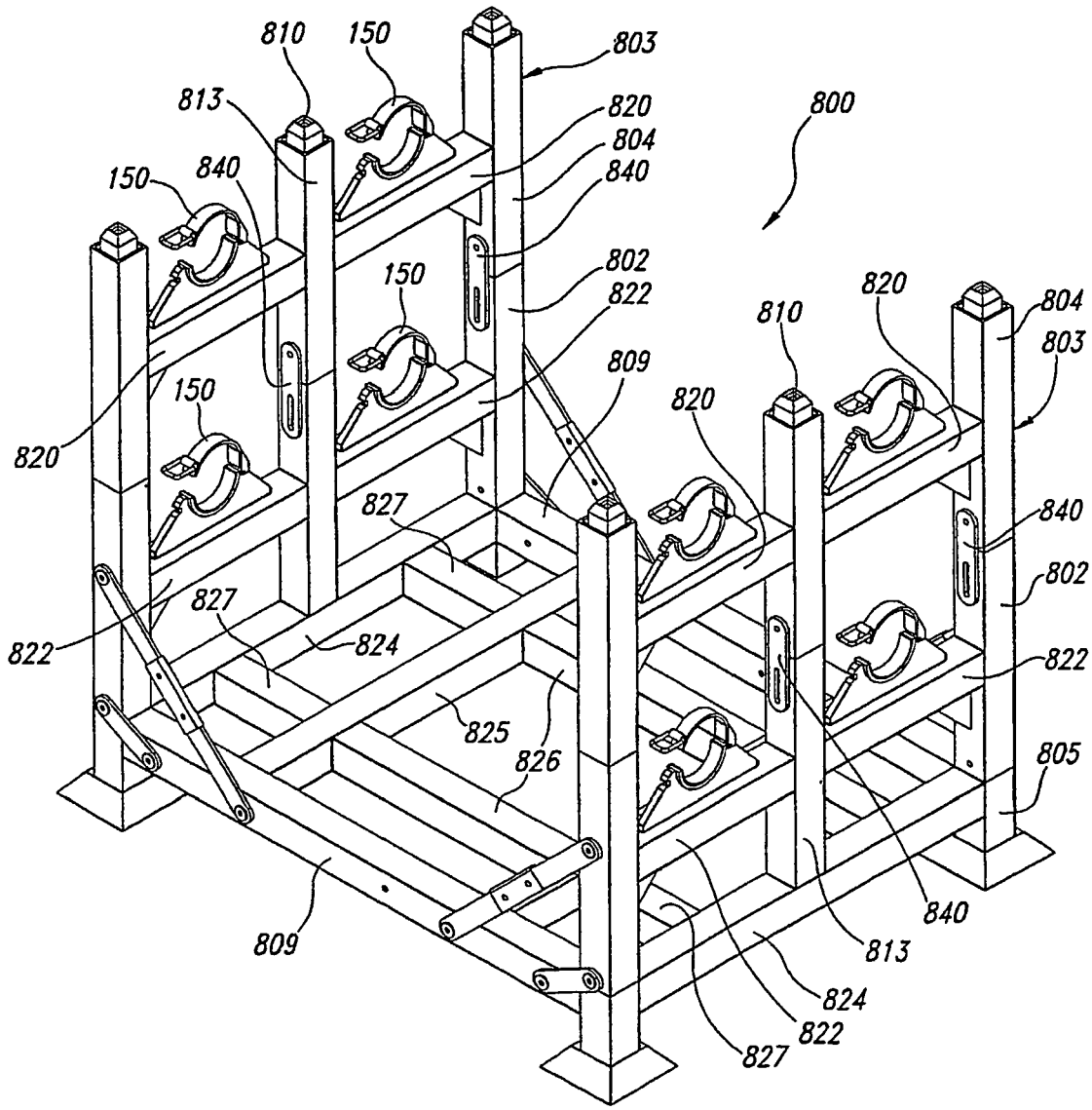
FIG. 19 shows a double-wide, double stacking unit according to another embodiment of the present invention.

FIG. 19 shows a double wide, double high unit 800 according to another embodiment of the present invention. According to this embodiment, when the unit 800 is in its unfolded position, at least four cores (not shown) can be stored in the four pairs of core holders 150. The unit 800 is similar in construction to the double-wide unit 400 of FIG. 3. However, it includes a pair of lower (third) end bars 824, two pairs of middle (second) end bars 822, and two pairs of upper (first) end bars 820. In particular, double-wide unit 800 that includes two opposing side bars 809 connected to two pairs of corner posts 803 with hinges (not shown). Hinges are also located (but not shown) at the joint between the center post and the lower end bars. As in previously described embodiments, the hinges allow the corner and center posts 803, 813 to fold flat when the double-wide unit 800 is collapsed into its collapsed position.

Between the two pairs of corner posts 803 are two opposing center posts 813, each connected to the corner posts 803 by a pair of lower end bars 824, two pairs of middle end bars 822, and two pairs of upper end bars 820. As shown in this exemplary embodiment, the center posts 813 do not include a foot below the lower end bars 824, but end at the upper surface of the lower end bars. In this embodiment, the base includes two support bars 825 (only one is visible), and longitudinal bars 826 connected between the support bars 825 and longitudinal bars 827 connected between the support bars 825 and the end bars 824.

On top of each of the center posts 813 is located a top end block 810, which can engage a recess (not shown) in the underside of the foot 805, when the units 800 are stacked in their open position. The top end blocks 810 on the center posts 813 provide stability when the double-wide unit 800 is stacked one on top of another in the open position. Core holders 150 are located on the center top of each of the pairs of upper end bars 820 and middle end bars 822. Additionally, though not shown, more core holders 150 could be positioned on lower end bars 824.

In this embodiment, to provide additional stability in the corner and center posts 803 and 813, respectively, brace plates 840 are fixed at the seams of the corner posts 803 and center posts 813 between the upper leg portions 804 and the middle leg portions 802 (labeled only on the corner posts for simplicity). In other respects, this embodiment is the same as that described in FIGS. 1A and 3, and no further description will be provided for the sake of brevity.

Figure 20A:
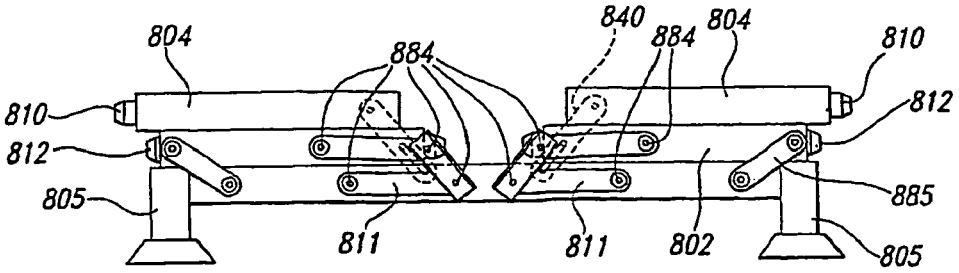
FIG. 20A is a side view of a rackable, collapsible and stackable unit according to one embodiment of the present invention in a closed position.
Figure 20B:
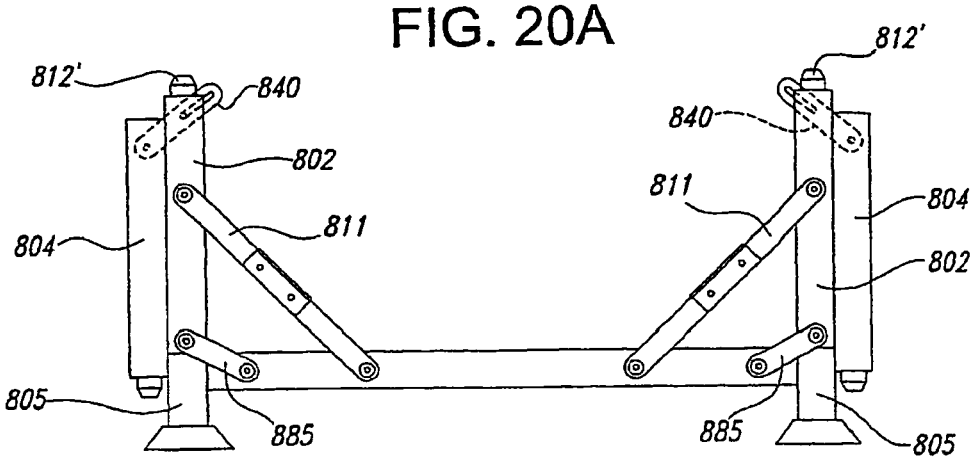
FIG. 20B is a side view of a rackable, collapsible and stackable unit according to one embodiment of the present invention in a partially opened position.
Figure 20C:
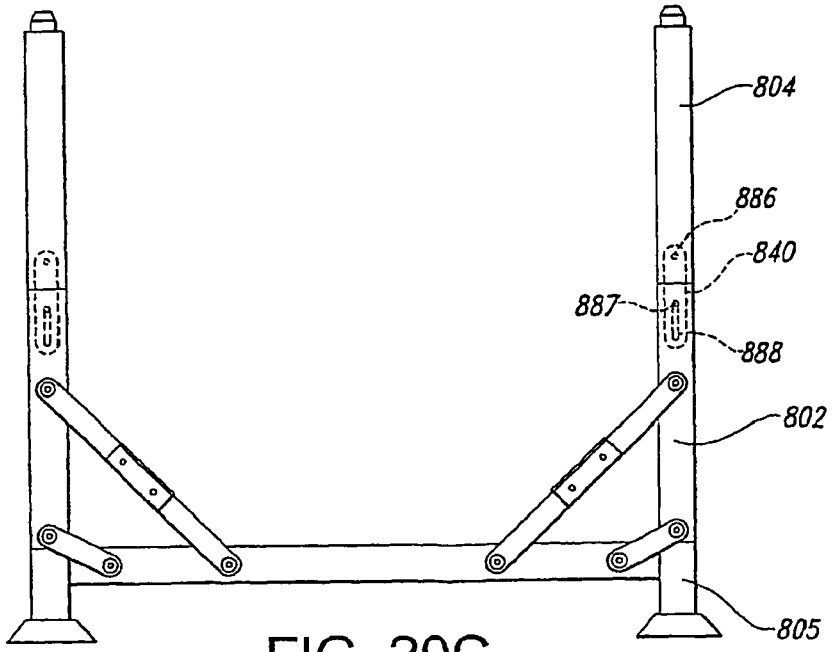
FIG. 20C is a side view of a rackable, collapsible and stackable unit according to one embodiment of the present invention in an opened position.

FIGS. 20A-20C show a side view of the double wide, double stacked embodiment of the present invention, illustrating the unit in the folded position (FIG. 20A), the partially unfolded position (FIG. 20B) and the unfolded position (FIG. 20C). This illustration, however, could apply to any of the disclosed embodiments, with modifications that are understood by those of ordinary skill in the art. To erect the unit, you begin by separating one unit from the other (only one unit shown in FIGS. 20A-20C). A person will take hold of middle leg portion 802, lift up and push back, aligning mating block 812 with a corresponding mating hole in foot portion 805 (not shown here) in a 90° position, and lowering the middle leg portion 802 into place. Hinge 811 automatically locks in place. This results in the partially open configuration shown in FIG. 20B. The lower portion is now ready to be loaded with product. This process is then repeated for the upper leg portion 804 until it is positioned atop the middle leg portion 802 using mating block 812' and a corresponding mating hole in upper leg portion 804 (not shown).

Brace 840 pivots at a fixed point 886 (FIG. 20C), and pin 887 located on an upper portion of the middle leg portion 802 slides within an elongated slot 888 in brace 840. When the two leg portions are aligned in place, the brace 840 locks into place, and the unit is in the opened position as shown in FIG. 20C, and is now ready to be loaded with product.

Figure 22:
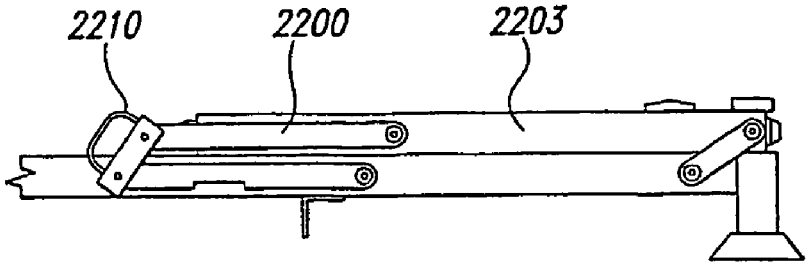
FIG. 22 is a partial view of one embodiment of a folding hinge with a handle according to the present invention.

FIG. 22 shows a hinge 2200 similar in construction to the hinge 811 of FIG. 20A-20C, but also including a handle 2210. The handle 2210 makes it easier to lift the leg 2203 into the upright position to erect the unit.

Figure 23:
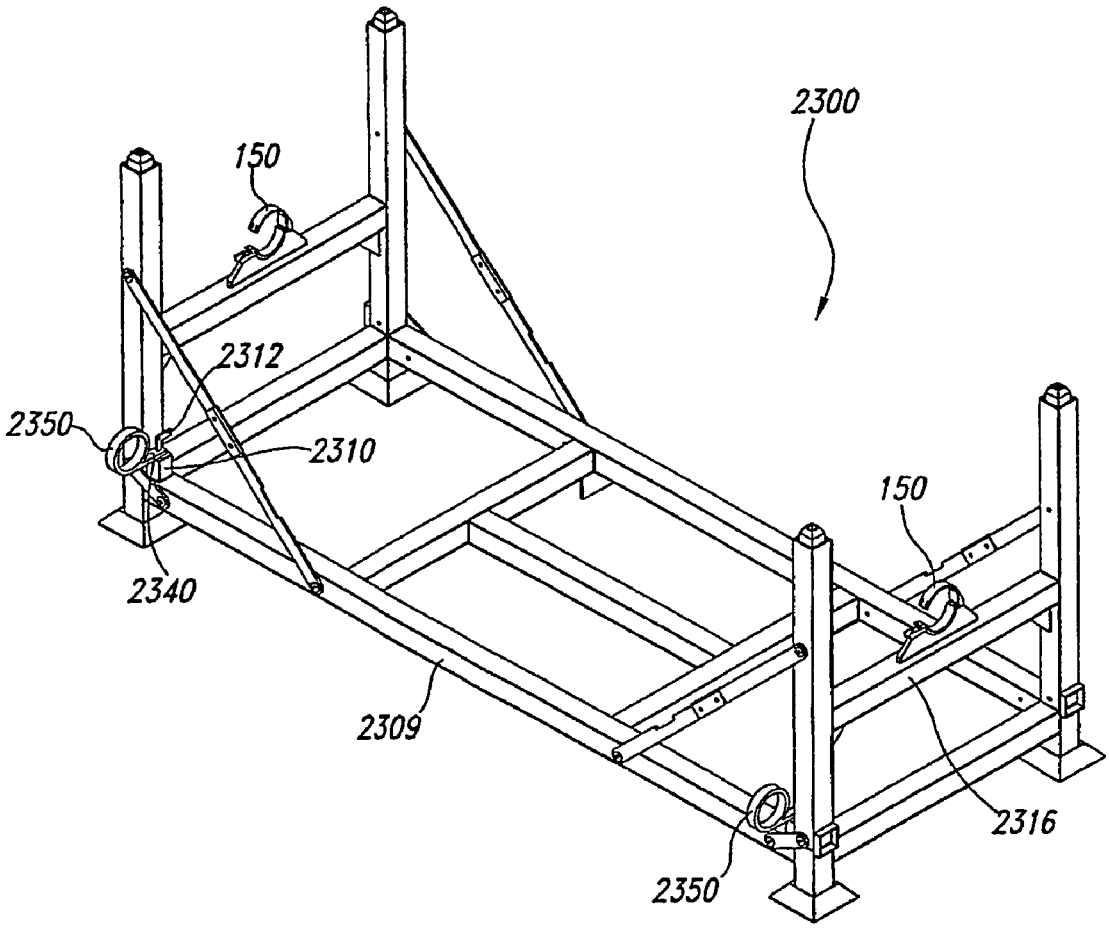
FIG. 23 is another embodiment of the unit according to the present invention.

FIG. 23 shows a unit according to another embodiment of the present invention. The unit 2300 includes a pair of core holders 150 located on upper end bars 2316. Additionally, the unit 2300 includes side core holders 2350 attached to one or both side bars 2309. The side core holders 2350 are formed of a rounded (or other feasible configuration) holder that is integrally connected with a straight handle 2340. The handle 2340 is inserted, via a hole (not shown) in the handle 2340 onto pins 2312, which extends from blocks 2310. Blocks 2310 are fixed to side bars 2309 at opposite ends thereof. The core (not shown) slides into the core holders 2350 for storage, and or transport.

Figure 24:
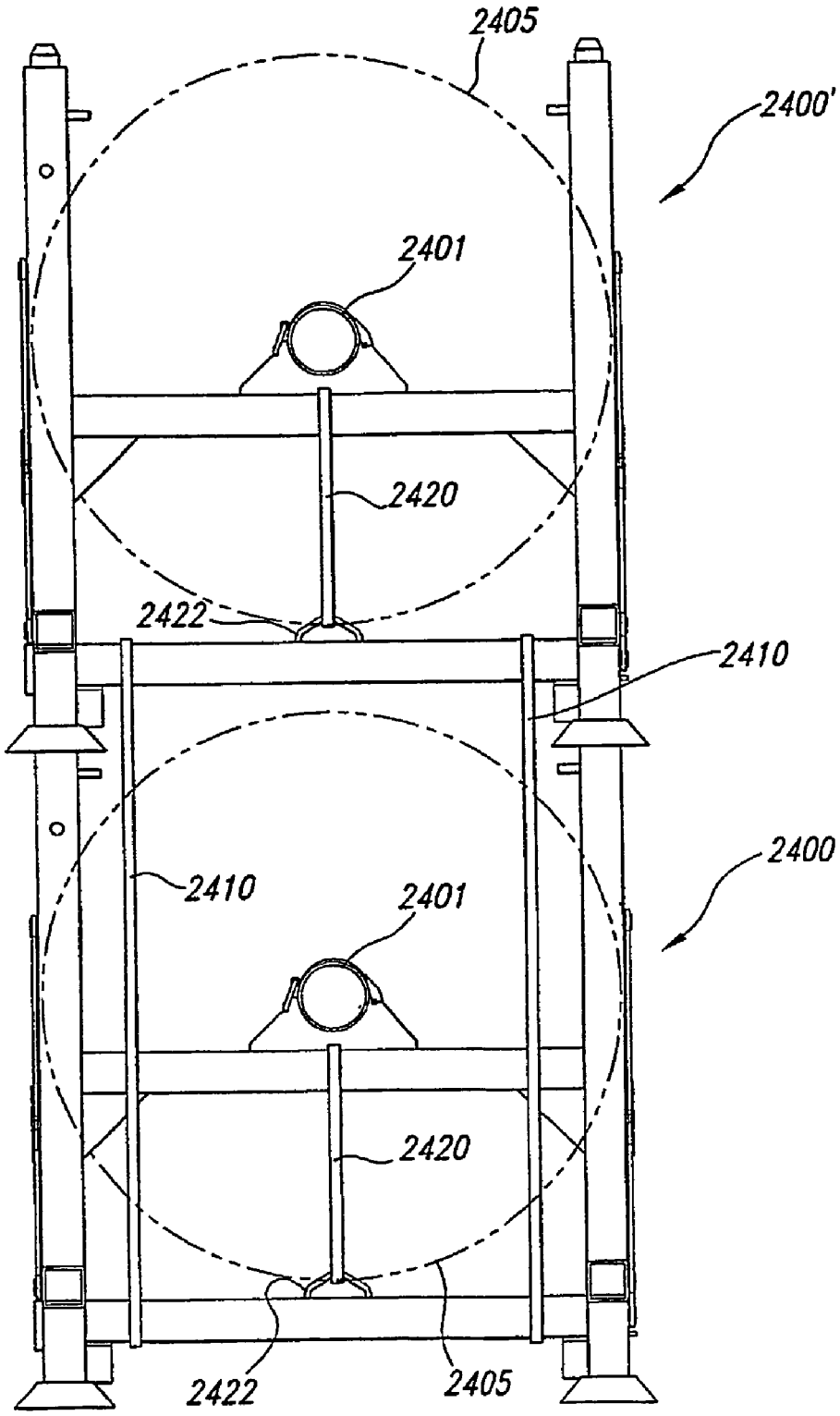
FIG. 24 is an end view of one embodiment of the present invention in a stacked position with straps used to stabilize the stacked units.

FIG. 24 shows an end view of two stackable units 2400, 2400', stacked one on top of another. The stackable units 2400, 2400' can have any suitable configuration, such as the exemplary embodiments discussed above. However, in this case, the units include first straps 2410, which allows the units to be securely fastened to each other during shipment. The strapping hooks 2422 allows a second strap 2420 to be run between the core 2401 and the material roll 2405, then back down through the strapping hook 2422 itself. This keeps the material roll 2405 from moving on the core 2401 and stops any sway motion when the unit is being handled by forklift or during shipment.

Figure 25A:
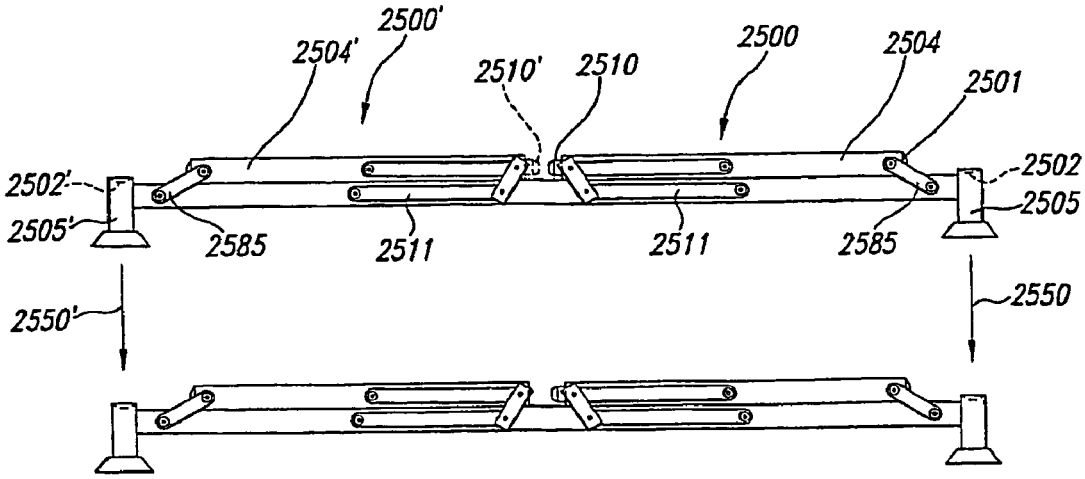
FIGS. 25A-25C illustrate how a unit according to the present invention can be collapsed within itself to be folded as flat as possible according to various embodiments of the present invention.
Figure 25B:
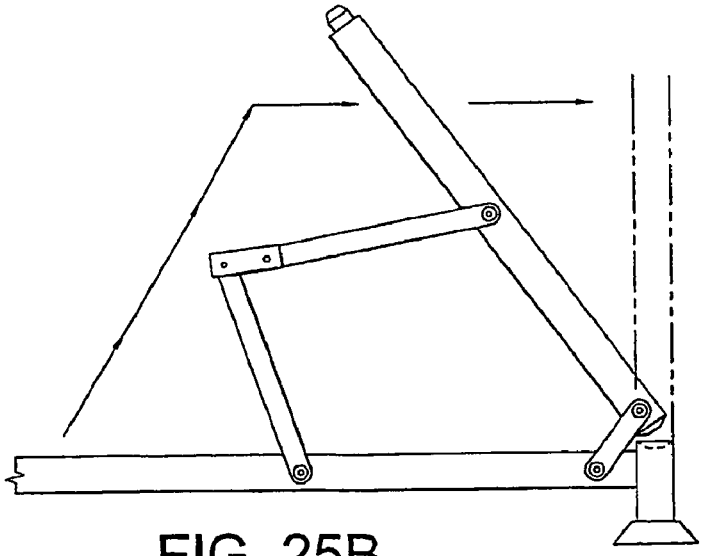
Figure 25C:
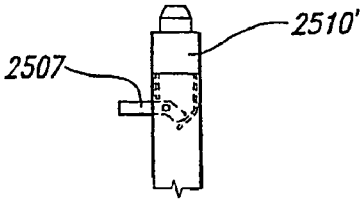

FIGS. 25A-25C illustrate how a unit according to the present invention can be collapsed within itself to be folded as flat as possible according to various embodiments of the present invention. FIG. 25A shows that a unit can be considered to consist of two ends, 2500 and 2500'. Both ends are hinged to the base of the unit to allow the unit to collapse within itself. When erected, the ends are parallel and mirrored symmetrically.

Ends 2500, 2500' each have two interlocking pieces, one between portions of the corner posts and one adapted to engage between two units stacked one on top of another Mating blocks 2501, 2501' provided on the upper leg portions 2504, 2504' of the corner posts mate and engage with mating holes 2502, 2502' provided in the foot portions 2505, 2505'. When the corner posts stand erect, the mating blocks 2501, 2501' engage with the mating holes 2502, 2502' to secure the corner posts in an upright position.

Top end blocks 2510, 2510' allow the unit to interlock with other similar units for multiple stacking. In the configuration shown in FIG. 25A, ends 2500 and 2500' may be too tall to fold together to completely collapse on the unit frame. Accordingly, one or both of the top end blocks 2510, 2510' may be detachable. If they are detached they can be stored within a compartment (not shown) on the unit base to permit collapse of the unit onto itself. In the embodiment shown in FIG. 25A, the top end block 2510 on end 2500 is not detachable, i.e., is permanently fixed to or integrally formed with end 2500, and the top end block 2510' on end 2500' is detachable (as shown in dashed lines). Hinged support brace 2511 and hinge 2585 collapse at a degree of angle away from the end of the unit.

In this embodiment, the core protector latches fit into holes on the upper leg (not shown), when the unit is in the collapsed position. This leaves the unit clear to rest on the top portion of the corner posts without the need of strapping or anything else to secure units together for transport.

The top unit sets down onto the bottom unit (see arrows 2550, 2550'). This design permits the user to conserve several inches inside a truck or container when shipping the stacked units.

To erect the unit, you begin by separating one unit from the other. A person will take hold of upper leg portions 2504, 2504', lift up and push back, aligning mating block 2501, 2501' with a corresponding mating hole 2502, 2502' in a 90° position, and lowering the upper leg portions 2504, 2504' into place. Hinged support brace 2511 automatically locks in place. This results in the partially open configuration shown in FIG. 25B. When the two leg portions are aligned in place, the hinge 2585 locks into place, and the unit is in the opened position and is now ready to be loaded with product. FIG. 25C illustrates an alternative configuration that includes a leg lock 2507 that removably connects the top end block 2510 (shown having a slightly different shape than in FIG. 25A) to the upper leg portion 2504'.

Figure 26A:
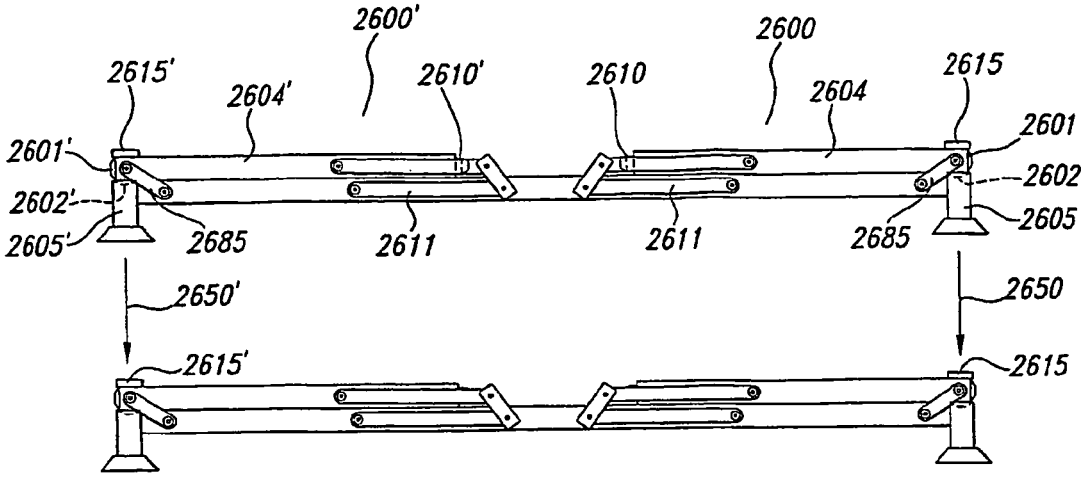
FIGS. 26A-26B illustrate how a unit according to the present invention can be collapsed within itself to be folded as flat as possible according to various embodiments of the present invention.
Figure 26B:
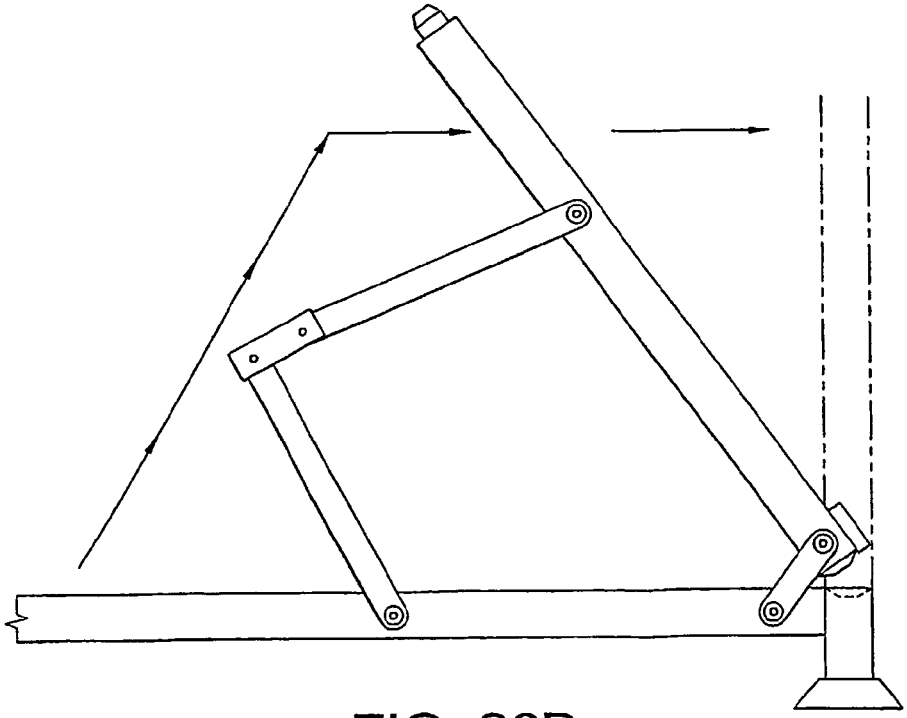

FIGS. 26A-26B illustrate how a unit according to the present invention can be collapsed within itself to be folded as flat as possible according to various embodiments of the present invention. The embodiment shown in FIGS. 26A-26B are in most respects the same as that shown in FIGS. 25A-25B. However, the embodiment of FIGS. 26A-26B also include a mating block 2615, 2615' provided on each upper leg portion 2604, 2604' for allowing the stacking units to interlock more securely when stacked in a collapsed position. The foot portions 2605, 2605' of the top unit set down and engage with the mating blocks 2615, 2615' of the lower unit. The description of the similarly numbered parts with respect to FIG. 25A-25B will be omitted and the reader is invited to the description of FIGS. 25A-25B for a specific discussion of these similar parts.

Figure 27:
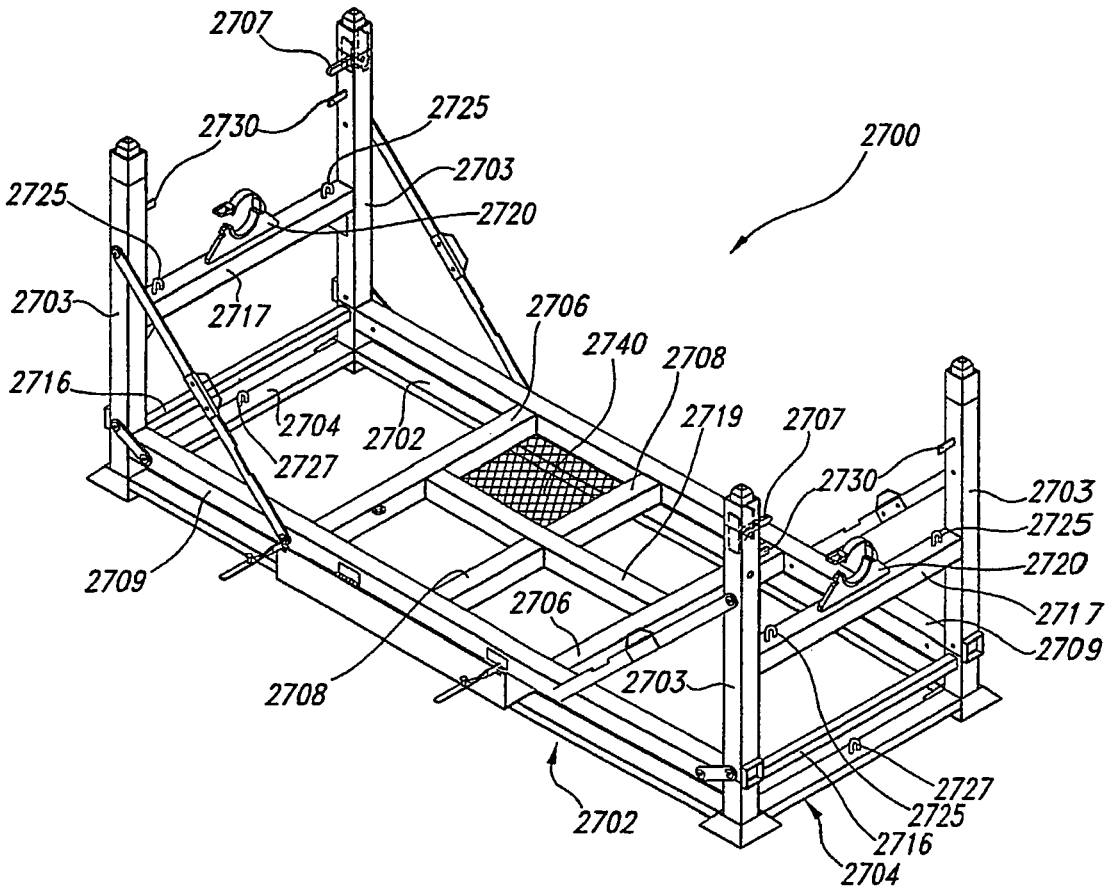
FIG. 27 illustrates a unit according to another embodiment of the present invention.
Figure 28:
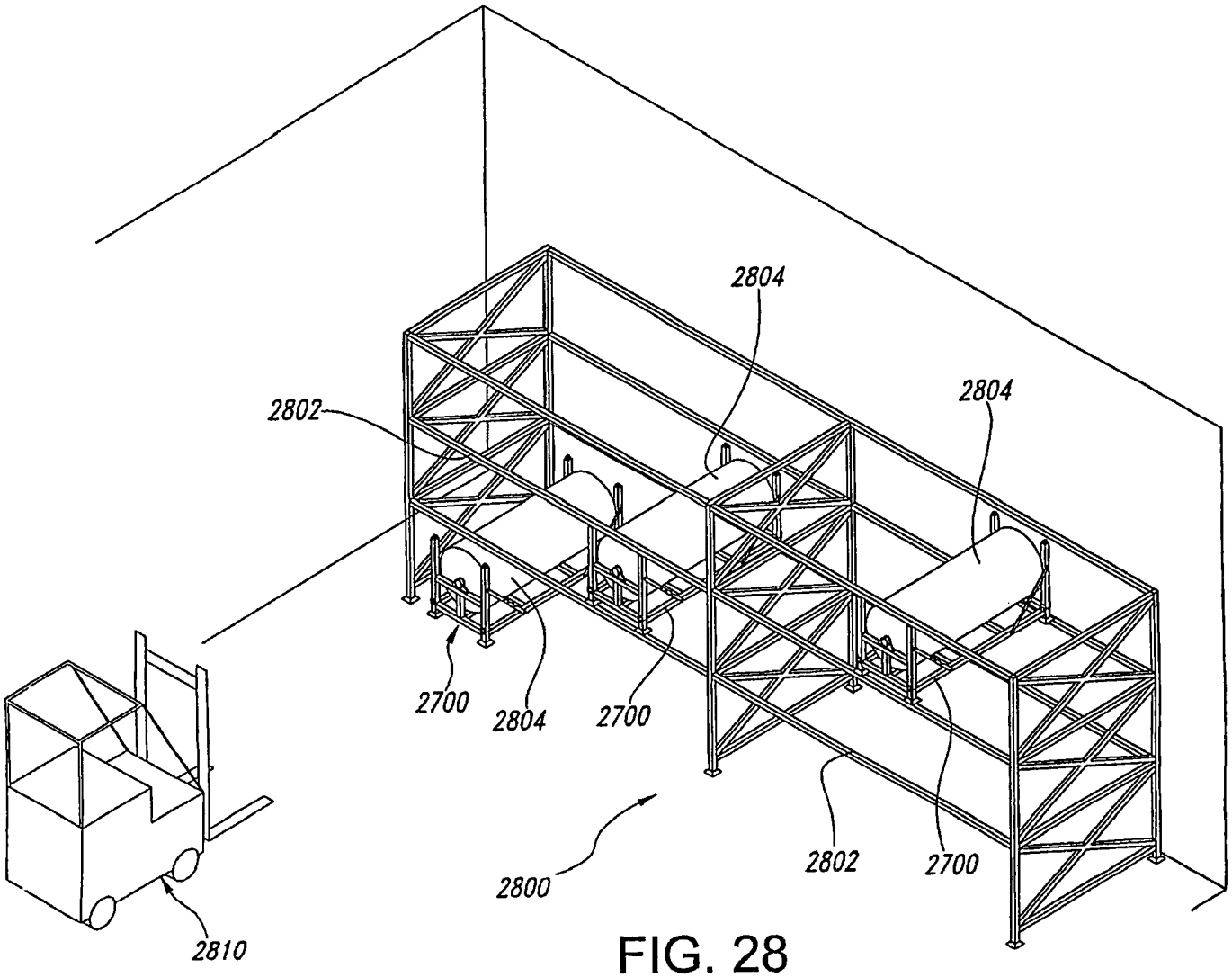
FIG. 28 illustrates units constructed according to the present invention racked on storage shelves.

FIG. 27 illustrates unit 2700 including another embodiment of the present invention. In particular, unit 2700 includes racking, anti-tilt side bars 2702 connecting two opposing corner posts 2703 and racking, anti-tilt end bars 2704, connecting two adjacent corner posts 2703. The racking, anti-tilt side and end bars 2702, 2704 are positioned lower than the side and end bars 2709, 2716, substantially flush with the bottom surface of the corner posts. The racking, anti-tilt side and end bars can be used to allow a forklift 2810 (FIG. 28) to pick up and move the unit 2700 easily and safely. Further, the racking, anti-tilt side and end bars provide additional stability to the unit to prevent the units from tilting or tipping over, particularly when loaded with heavy material rolls. As shown in FIG. 28, the units 2700 according to one embodiment of the present invention can be placed on racks 2800, on the shelves 2802 for storage. In this case, the units 2700 are shown in the open position and loaded with material rolls 2804.

In this embodiment, the upper end bars 2717, in addition to the core holders 2720, include two strap hooks 2725, one on either side of the core holder 2720. Strap hooks 2725 can be used to strap two stacked units together securely when they are stacked in the open position (strap not shown). The racking, anti-tilt end bars 2704 include strap hooks 2727 positioned in a substantially central location an upper surface of the end bars 2704. The strap hooks 2727 can be used to strap the rolled material (not shown) in the unit 2700 (strap not shown).

The embodiment of FIG. 27 also shows the provision of handles 2730 on each corner post, on an inner surface thereof. Handles 2730 can be used to pull up on the corner posts 2703 when the unit 2700 is being opened into the open position from the closed position.

The embodiment of FIG. 27 illustrates a different configuration of the support bars provided between the side bars 2709 and end bars 2716. This alternative configuration can be used in any other embodiment discussed above, as can the racking, anti-tilt bars 2702, 2704. The unit 2700 includes two first cross support bars 2706 connecting the side bars 2709, each positioned at approximately one-third of the length of the side bars (thus, dividing the base into approximate thirds). A longitudinal support bar 2719 connects the two first cross support bars 2706 and is located substantially in the middle of the cross support bars 2706. Further, at an approximately middle position of the longitudinal support bar 2719, two second cross support bars 2708 are connected between each side of the longitudinal support bar 2719 and the respective side bar 2709. In one or more of the sections created by this configuration, a netting 2740 or other material may be connected to form a storage area for the top end blocks and/or the various portions of the corner posts 2703 when they are separated when the unit is in the closed position.

The units according the present invention can be made of wood, plastic, or metal. The hinges and braces can be made of suitable materials, such as metal.

The units according to the present invention are constructed so as to provide a unit that is totally collapsible. This makes it more economical to use for storage and/or shipment, while using minimum truck and warehouse space. The base of the unit, and the bars that make up the base and the unit, can be round, square, rectangular, cone shaped, octagonal, or any combination of shapes. The length and width of the base can be made stationary or adjustable, varying in all scalable dimensions in accordance with the specific requirements for the unit. The base can be formed in one solid piece, of any suitable material. The base can be covered with expanded metal, perforated metal, or solid metal in accordance with what is required for shipping.

The legs can be made in any convenient or desired shape, including round, square, rectangular, cone shaped, octagonal shaped, or any combination of shapes. The leg height varies in all scalable dimensions in accordance with specific requirements for the products to be transported or supported, and the legs can be made stationary or adjustable. The leg width also varies in all scalable dimensions in accordance with specific requirements for the products, and can be made stationary or adjustable.

Although various features are shown in the exemplary embodiments as being included in specific embodiments, it is believed to be within the skill of the ordinary artisan to mix and match those features and include the desired ones in alternative embodiments, as required and/or desired. Such mixing and matching of the various disclosed features is intended to be within the scope of the invention as recited in the appended claims.

The foregoing description of the specific embodiments will so fully reveal the general nature of the invention that others can, by applying current knowledge, readily modify and/or adapt for various application such specific embodiments without undue experimentation and without departing from the generic concept. Therefore, such adaptations and modifications should and are intended to be comprehended within the meaning and range of equivalents of the disclosed embodiments.

It is to be understood that the phraseology or terminology employed herein is for the purpose of description and not of limitation. The means and materials for carrying out various disclosed functions may take a variety of alternative forms without departing from the invention.

Thus, the expressions "means to . . . " and "means for . . . " as may be found in the specification above and/or in the claims below, followed by a functional statement, are intended to define and cover whatever structural, physical, chemical, or electrical element or structures which may now or in the future exist for carrying out the recited function, whether or nor precisely equivalent to the embodiment or embodiments disclosed in the specification above. It is intended that such expressions be given their broadest interpretation.

What is claimed is:

1. A rackable, collapsible, and stackable unit comprising:

two pairs of adjacent and opposite upright corner posts being foldable inwardly and downwardly;

two side bars, each side bar connecting the pair of opposite upright corner posts;

a pair of upper end bars, each upper end bar connecting the pair of adjacent upright corner posts;

a pair of lower end bars, each lower end bar connecting the pair of adjacent upright corner posts, positioned at a point lower than the pair of upper end bars on the corner posts;

at least two first core holders located on the pair of upper end bars for retaining a core;

a plurality of hinges, one connected at each joint between each corner post and the side bars whereby the unit can collapse inwardly, wherein said plurality of hinges comprises at least four double-pinned hinges, each one pivotally and diagonally connected between one of the corner posts and one of the side bars; and at least four hinged support braces, each one pivotally and diagonally connected between one of the corner posts and one of the side bars to hold the corner posts in an upright position when the unit is opened and which, in combination with the hinges, makes it possible to fold the corner posts inwardly and downwardly so as to lie substantially flat against the side bars.

2. The unit of claim 1, further comprising: at least one cross bar connected between the side bars; and at least one longitudinal bar connected between the at least one cross bar and each one of the pair of lower end bars.

3. A core for use with the unit of claim 2, wherein the core comprises a hollow tube; and core plugs sized and shaped so as to fit on each end of the hollow tube to seal the tube, the core plugs comprising two ridges extending radially outwardly around a circumference of the core plugs to retain the core in place on the core holders.

4. A core for use with the unit of claim 2, wherein the core comprises: a solid mandrel having an opening in each end; and core plugs sized and shaped so as to fit in the openings in each end of the solid mandrel, the core plugs comprising two ridges extending radially outwardly around the circumference of the core plugs to retain the core in place on the core holders.

5. The unit of claim 1, further comprising at least one upright support end bar connected between the upper end bars and the lower end bars in a substantially center position between the adjacent corner posts.

6. The unit of claim 1, wherein each corner post further comprising at least one top end block at an upper end of each corner post for engaging an opening formed in an underside of a corresponding corner post of another unit when the units are stacked on top of each other in an opened position.

7. The unit of claim 1, further comprising a stacking lock connected to an outside surface of each corner post for engaging an opening formed in an underside of a corresponding corner post of another unit when the units are stacked on top of each other in a closed position.

8. The unit of claim 1, wherein the core comprises: a hollow tube; and core plugs sized and shaped so as to fit on each end of the hollow tube to seal the tube, the core plugs comprising two ridges extending radially outwardly around a circumference of the core plugs to retain the core in place on the core holders.

9. The unit of claim 1, wherein the core comprises: a solid mandrel having an opening in each end; and core plugs sized and shaped so as to fit in the openings in each end of the solid mandrel, the core plugs comprising two ridges extending radially outwardly around the circumference of the core plugs to retain the core in place on the core holders.

10. A rackable, collapsible, and stackable unit comprising:

two pairs of adjacent and opposite upright corner posts being foldable inwardly and downwardly;

two side bars, each side bar connecting the pair of opposite upright corner posts;

a pair of upper end bars, each upper end bar connecting the pair of adjacent upright corner posts;

a pair of lower end bars, each lower end bar connecting the pair of adjacent upright corner posts, positioned at a point lower than the pair of upper end bars on the corner posts;

at least two first core holders located on the pair of upper end bars for retaining a core;

a plurality of hinges, one connected at each joint between each corner post and the side bars whereby the unit can collapse inwardly; and at least four hinged support braces, each one pivotally and diagonally connected between one of the corner posts and one of the side bars to hold the corner posts in an upright position when the unit is opened and which, in combination with the hinges, makes it possible to fold the corner posts inwardly and downwardly so as to lie substantially flat against the side bars, wherein the at least four hinged support braces are connected to the respective corner posts and side bars at first and second pivot pins, and wherein the hinged support braces comprise a center plate and two end plates, the center plate comprises a hole on each end thereof, and each of two end plates includes a hole formed therein on both ends to accommodate the first and second pivot pins connecting the braces to the respective corner posts and side bars, and third and fourth pivot pins that connect the center plate to a respective end plate.

* * * * *